US010871723B2

(12) United States Patent
Okawa et al.

(10) Patent No.: US 10,871,723 B2
(45) Date of Patent: Dec. 22, 2020

(54) ELECTROPHOTOGRAPHIC PHOTOSENSITIVE MEMBER AND IMAGE FORMING APPARATUS

(71) Applicant: KYOCERA Document Solutions Inc., Osaka (JP)

(72) Inventors: Kensuke Okawa, Osaka (JP); Seiki Hasunuma, Osaka (JP); Jun Azuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/496,487

(22) PCT Filed: Dec. 28, 2017

(86) PCT No.: PCT/JP2017/047261
§ 371 (c)(1),
(2) Date: Sep. 23, 2019

(87) PCT Pub. No.: WO2018/179658
PCT Pub. Date: Oct. 4, 2018

(65) Prior Publication Data

US 2020/0026207 A1 Jan. 23, 2020

(30) Foreign Application Priority Data

Mar. 31, 2017 (JP) ..... 2017-070683

(51) Int. Cl.
*G03G 5/06* (2006.01)
*G03G 5/05* (2006.01)

(52) U.S. Cl.
CPC ..... *G03G 5/0696* (2013.01); *G03G 5/056* (2013.01); *G03G 5/0662* (2013.01); *G03G 5/0614* (2013.01)

(58) Field of Classification Search
CPC .... G03G 5/056; G03G 5/0696; G03G 5/0662; G03G 5/0659
See application file for complete search history.

(56) References Cited

U.S. PATENT DOCUMENTS 4,842,970 A * 6/1989 Tai ..... G03G 5/0696 430/59.4
5,120,627 A * 6/1992 Nozomi ..... G03G 5/0525 427/74

(Continued)

FOREIGN PATENT DOCUMENTS

JP 02289575 A * 11/1990
JP 08286397 A * 11/1996
JP H10288845 A 10/1998

OTHER PUBLICATIONS

English translation of JP-02289575-A. (Year: 1990).*
English language machine translation of JP-08286397-A (Year: 1996).*

*Primary Examiner* — Christopher D Rodee
(74) *Attorney, Agent, or Firm* — Studebaker & Brackett PC

(57) ABSTRACT

An electrophotographic photosensitive member (1) includes a conductive substrate (2) and a photosensitive layer (3) disposed directly or indirectly on the conductive substrate (2). The photosensitive layer (3) has a charge generating layer (3*a*) and a charge transport layer (3*b*) disposed in order from the conductive substrate (2). The charge generating layer (3*a*) contains a charge generating material. The charge transport layer (3*b*) contains a charge transport material, a binder resin, and a pigment that absorbs light having an irradiation wavelength. The binder resin includes a polyarylate resin including a repeating unit represented by general formula (1):

(1)

In general formula (1), X and Y each represent, independently of one another, a divalent group represented by chemical formula (1-1), (1-2), (1-3), or (1-4):

(1-1)

(1-2)

(1-3)

(Continued)

-continued (1-4)

The pigment is a naphthalocyanine compound represented by general formula (2) or (3):

(2)

-continued (3)

15 Claims, 3 Drawing Sheets

(56) References Cited

U.S. PATENT DOCUMENTS 5,187,036 A * 2/1993 Matsui ..... G03G 5/0616 430/58.4
6,824,938 B2 * 11/2004 Kizaki ..... G03G 5/142 399/159

* cited by examiner

ELECTROPHOTOGRAPHIC PHOTOSENSITIVE MEMBER AND IMAGE FORMING APPARATUS

TECHNICAL FIELD

The present invention relates to an electrophotographic photosensitive member and an image forming apparatus.

BACKGROUND ART

Electrophotographic photosensitive members are used as image bearing members of electrophotographic image forming apparatuses (for example, printers and multifunction peripherals). Electrophotographic photosensitive members each include a photosensitive layer. Examples of electrophotographic photosensitive members include single-layer electrophotographic photosensitive members and multilayer electrophotographic photosensitive members. The single-layer electrophotographic photosensitive members each include a photosensitive layer having a charge generation function and a charge transport function. The multilayer electrophotographic photosensitive members each include a photosensitive layer including a charge generating layer having a charge generation function and a charge transport layer having a charge transport function.

Patent Literature 1 discloses an electrophotographic photosensitive member containing a polyarylate resin represented by chemical formula (R-A) shown below.

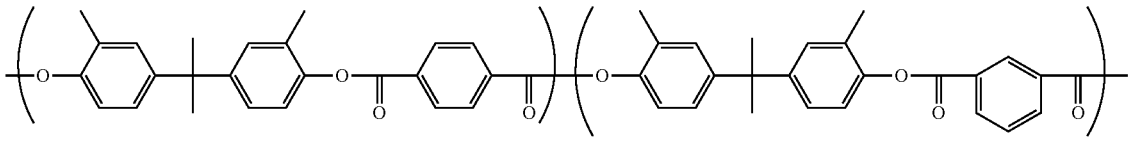

(R-A)

CITATION LIST

Patent Literature

Patent Literature 1

Japanese Patent Application Laid-Open Publication No. H0-288845

SUMMARY OF INVENTION

Technical Problem

However, abrasion resistance of the electrophotographic photosensitive member disclosed in Patent Literature 1 is not sufficient.

Furthermore, a photosensitive layer of the electrophotographic photosensitive member is abraded through repeated use of the electrophotographic photosensitive member to result in a decrease in thickness thereof, and electrical characteristics of the electrophotographic photosensitive member may be reduced due to the decrease in thickness of the photosensitive layer.

The present invention has been made in view of the problems described above, and an object thereof is to provide an electrophotographic photosensitive member that is excellent in abrasion resistance and is capable of inhibiting reduction of its electrical characteristics due to a decrease in thickness of a photosensitive layer thereof. Another object of the present invention is to provide an image forming apparatus that can offer a lower running cost.

Solution to Problem

An electrophotographic photosensitive member according to the present invention includes a conductive substrate and a photosensitive layer disposed directly or indirectly on the conductive substrate. The photosensitive layer has a charge generating layer and a charge transport layer disposed in order from the conductive substrate. The charge generating layer contains a charge generating material. The charge transport layer contains a charge transport material, a binder resin, and a pigment that absorbs light having an irradiation wavelength. The binder resin includes a polyarylate resin including a repeating unit represented by general formula (1) shown below. The pigment is a naphthalocyanine compound represented by general formula (2) or general formula (3) shown below.

(1)

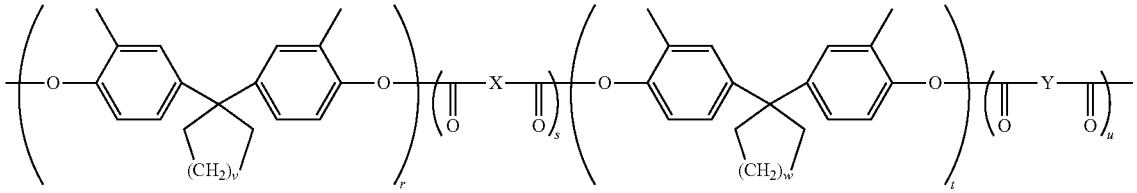

In general formula (1), v and w each represent, independently of one another, 2 or 3. r, s, t, and u each represent, independently of one another, a number greater than or equal to 0. r+s+t+u===100. r+t=s+u. r/(r+t) is at least 0.00 and no greater than 0.90. s/(s+u) is at least 0.00 and no greater than 0.90. X and Y each represent, independently of one another, a divalent group represented by chemical formula (1-1), chemical formula (1-2), chemical formula (1-3), or chemical formula (1-4) shown below.

(1-1)

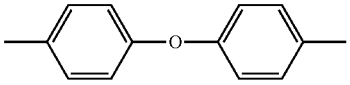

(1-2)

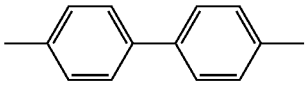

(1-3)

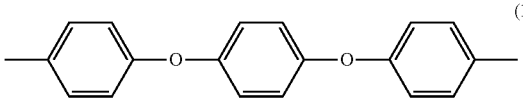

(1-4)

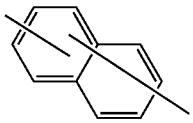

(2)

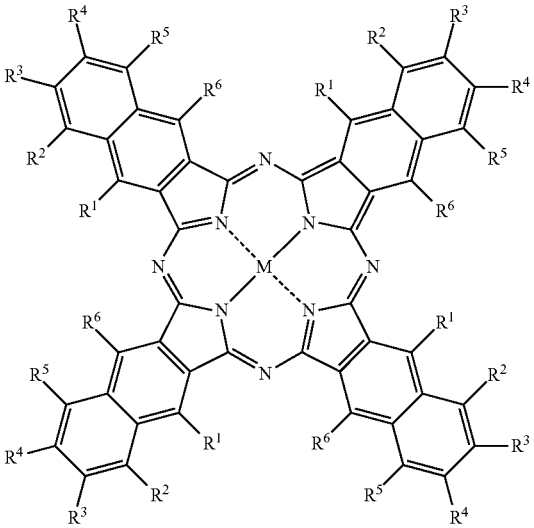

In general formula (2), $R^1$, $R^2$, $R^3$, $R^4$, $R^5$, and $R^6$ each represent, independently of one another, a hydrogen atom, an alkyl group optionally having a substituent and having a carbon number of at least 1 and no greater than 6, an aryl group optionally having a substituent and having a carbon number of at least 6 and no greater than 14, an alkoxy group optionally having a substituent and having a carbon number of at least 1 and no greater than 6, a phenoxy group optionally having a substituent, a thioalkyl group optionally having a substituent and having a carbon number of at least 1 and no greater than 6, or a thiophenyl group optionally having a substituent, with the proviso that $R^1$, $R^2$, $R^3$, $R^4$, $R^5$, and $R^6$ do not all simultaneously represent hydrogen atoms. M represents a metal atom optionally having a ligand.

(3)

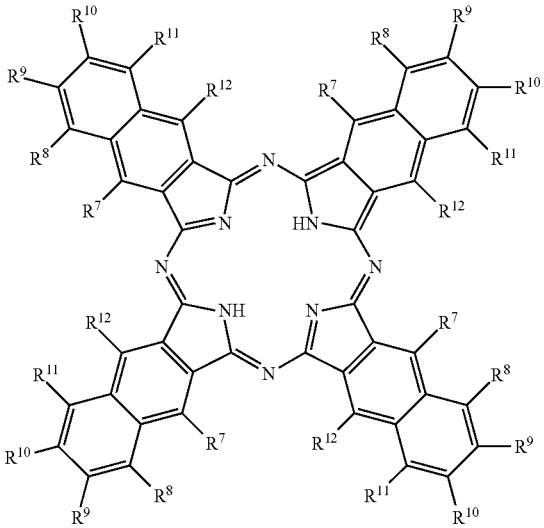

In general formula (3), $R^7$, $R^8$, $R^9$, $R^{10}$, $R^{11}$, and $R^{12}$ each represent, independently of one another, a hydrogen atom, an alkyl group optionally having a substituent and having a carbon number of at least 1 and no greater than 6, an aryl group optionally having a substituent and having a carbon number of at least 6 and no greater than 14, an alkoxy group optionally having a substituent and having a carbon number of at least 1 and no greater than 6, a phenoxy group optionally having a substituent, a thioalkyl group optionally having a substituent and having a carbon number of at least 1 and no greater than 6, or a thiophenyl group optionally having a substituent, with the proviso that $R^7$, $R^8$, $R^9$, $R^{10}$, $R^{11}$, and $R^{12}$ do not all simultaneously represent hydrogen atoms.

An image forming apparatus according to the present invention includes an image bearing member, a charger, a light exposure section, a developing section, and a transfer section. The image bearing member is the above-described electrophotographic photosensitive member. The charger charges a surface of the image bearing member. The light exposure section exposes the charged surface of the image bearing member to light to form an electrostatic latent image on the surface of the image bearing member. The developing section develops the electrostatic latent image into a toner image. The transfer section transfers the toner image from the image bearing member to a transfer target.

Advantageous Effects of Invention

The electrophotographic photosensitive member according to the present invention is excellent in abrasion resistance and is capable of inhibiting reduction of its electrical characteristics due to a decrease in thickness of the photosensitive layer. The image forming apparatus according to the present invention can offer a lower running cost.

DESCRIPTION OF EMBODIMENTS

Figure 1:
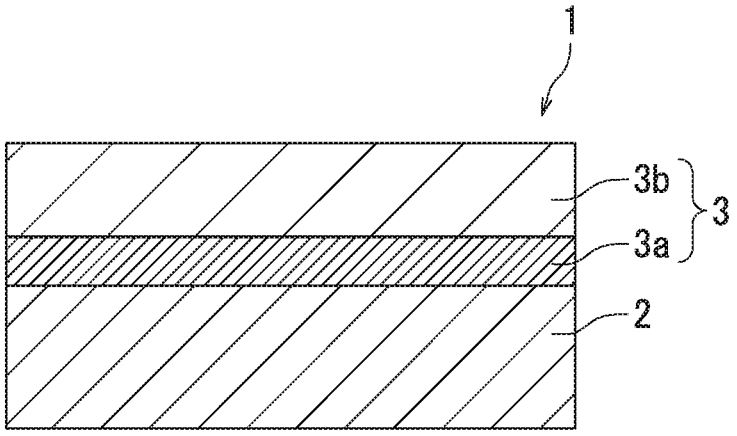
FIG. 1 is a partial cross-sectional view illustrating an example of a structure of an electrophotographic photosensitive member according to a first embodiment of the present invention.

The following describes embodiments of the present invention in detail. However, the present invention is not in any way limited by the embodiments described below and appropriate variations may be made in practice within the intended scope of the present invention. Although description is omitted as appropriate in some instances in order to avoid repetition, such omission does not limit the essence of the present invention. The term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

Hereinafter, an alkyl group having a carbon number of at least 1 and no greater than 6, an alkyl group having a carbon number of at least 1 and no greater than 4, an aryl group having a carbon number of at least 6 and no greater than 14, an alkoxy group having a carbon number of at least 1 and no greater than 6, an alkoxy group having a carbon number of at least 1 and no greater than 4, a thioalkyl group having a carbon number of at least 1 and no greater than 6, an aryloxy group having a carbon number of at least 6 and no greater than 14, and a halogen atom each refer to the following.

An alkyl group having a carbon number of at least 1 and no greater than 6 as used herein refers to an unsubstituted straight chain or branched chain alkyl group. Examples of the alkyl group having a carbon number of at least 1 and no greater than 6 include a methyl group, an ethyl group, a propyl group, an isopropyl group, an n-butyl group, an s-butyl group, a t-butyl group, a pentyl group, an isopentyl group, a neopentyl group, and a hexyl group.

An alkyl group having a carbon number of at least 1 and no greater than 4 as used herein refers to an unsubstituted straight chain or branched chain alkyl group. Examples of the alkyl group having a carbon number of at least 1 and no greater than 4 include a methyl group, an ethyl group, a propyl group, an isopropyl group, an n-butyl group, an s-butyl group, and a t-butyl group.

An aryl group having a carbon number of at least 6 and no greater than 14 as used herein refers to an unsubstituted aryl group. Examples of the aryl group having a carbon number of at least 6 and no greater than 14 include an unsubstituted monocyclic aromatic hydrocarbon group having a carbon number of at least 6 and no greater than 14, an unsubstituted condensed bicyclic aromatic hydrocarbon group having a carbon number of at least 6 and no greater than 14, and an unsubstituted condensed tricyclic aromatic hydrocarbon group having a carbon number of at least 6 and no greater than 14. More specific examples of the aryl group having a carbon number of at least 6 and no greater than 14 include a phenyl group, a naphthyl group, an anthryl group, and a phenanthryl group.

An alkoxy group having a carbon number of at least 1 and no greater than 6 as used herein refers to an unsubstituted straight chain or branched chain alkoxy group. Examples of the alkoxy group having a carbon number of at least 1 and no greater than 6 include a methoxy group, an ethoxy group, an n-propoxy group, an isopropoxy group, an n-butoxy group, an s-butoxy group, a t-butoxy group, a pentyloxy group, an isopentyloxy group, a neopentyloxy group, and a hexyloxy group.

An alkoxy group having a carbon number of at least 1 and no greater than 4 as used herein refers to an unsubstituted straight chain or branched chain alkoxy group. Examples of the alkoxy group having a carbon number of at least 1 and no greater than 4 include a methoxy group, an ethoxy group, an n-propoxy group, an isopropoxy group, an n-butoxy group, an s-butoxy group, and a t-butoxy group.

A thioalkyl group having a carbon number of at least 1 and no greater than 6 as used herein refers to an unsubstituted straight chain or branched chain thioalkyl group. Examples of the thioalkyl group having a carbon number of at least 1 and no greater than 6 include a thiomethyl group, a thioethyl group, a thiopropyl group, a thiobutyl group, a thiopentyl group, and a thiohexyl group.

An aryloxy group having a carbon number of at least 6 and no greater than 14 as used herein refers to a group including an aryl group having a carbon number of at least 6 and no greater than 14 and having an oxygen atom bonded to a bond end of the aryl group. Examples of the aryloxy group having a carbon number of at least 6 and no greater than 14 include a phenoxy group, a naphthyloxy group, an anthryloxy group, and a phenanthryloxy group.

Examples of a halogen atom as used herein include a fluorine atom, a chlorine atom, a bromine atom, and an iodine atom.

In the following description, metal atoms that can form a complex in a naphthalocyanine ring include semi-metal atoms such as a silicon atom. Examples of such metal atoms include a silicon atom, a germanium atom, a tin atom, a copper atom, a zinc atom, a magnesium atom, a titanium atom, a vanadium atom, an aluminum atom, an indium atom, and a lead atom.

In the following description, a functional group "optionally having a substituent" means that some or all of hydrogen atoms in the functional group may be replaced with a substituent. An atom "optionally having a ligand" means that the atom may be coordinated with the ligand. The term "irradiation wavelength" as used in association with an image forming apparatus including an image bearing member (an electrophotographic photosensitive member) and a light exposure section means a wavelength of irradiation light to which a surface of the image bearing member is exposed by the light exposure section when an image is formed using the image forming apparatus.

First Embodiment: Electrophotographic Photosensitive Member

Figure 2:
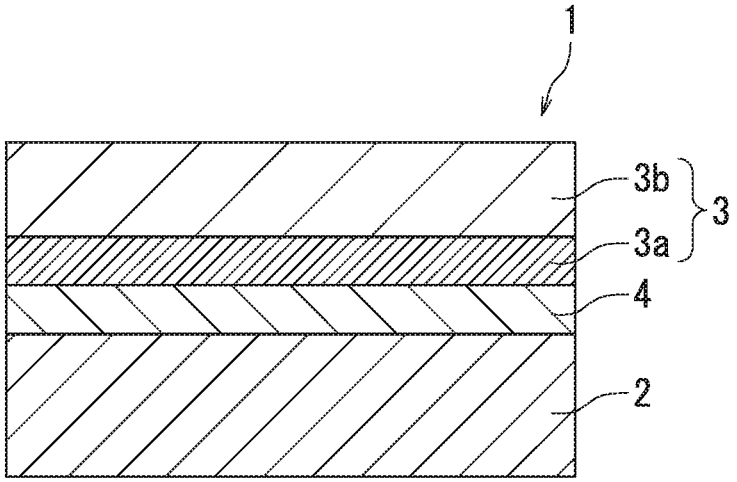
FIG. 2 is a partial cross-sectional view illustrating an example of the structure of the electrophotographic photosensitive member according to the first embodiment of the present invention.

The following describes a structure of an electrophotographic photosensitive member (also referred to below as a photosensitive member) according to a first embodiment of the present invention. FIGS. 1 and 2 are partial cross-sectional views each illustrating a structure of a photosensitive member 1, which is an example of the first embodiment. As illustrated in FIG. 1, the photosensitive member 1 includes a conductive substrate 2 and a photosensitive layer 3. The photosensitive layer 3 may be disposed directly on the conductive substrate 2 as illustrated in FIG. 1. Alternatively, the photosensitive member 1 may for example include the conductive substrate 2, an intermediate layer 4 (for example, an undercoat layer), and the photosensitive layer 3 as illustrated in FIG. 2. In the example illustrated in FIG. 2, the photosensitive layer 3 is indirectly disposed on the conductive substrate 2 with the intermediate layer 4 therebetween. The photosensitive layer 3 includes a charge generating layer 3*a* and a charge transport layer *b* disposed in order from the conductive substrate 2.

The charge generating layer 3*a* preferably has a thickness of at least 0.01 μm and no greater than 5 μm, and more preferably at least 0.1 μm and no greater than 3 μm. No particular limitations are placed on thickness of the charge transport layer 3*b* so long as the thickness thereof enables the charge transport layer 3*b* to sufficiently function as a charge transport layer. Approximately, the thickness of the charge transport layer 3*b* is for example at least 2 μm and no greater than 100 μm. Preferably, the thickness is at least 5 μm and no greater than 50 μm.

The following describes elements (the conductive substrate, the photosensitive layer, and the intermediate layer) of the photosensitive member according to the present embodiment. The following further describes a method for producing the photosensitive member.

[1. Conductive Substrate]

No particular limitations are placed on the conductive substrate other than being a conductive substrate that can be used in the photosensitive member. The conductive substrate can be a conductive substrate of which at least a surface portion is made from a material having conductivity. An example of the conductive substrate is a conductive substrate made from a material having conductivity (a conductive material). Another example of the conductive substrate is a conductive substrate having a conductive material coating. Examples of conductive materials include aluminum, iron, copper, tin, platinum, silver, vanadium, molybdenumn, chromium, cadmium, titanium, nickel, palladium, and indium. Any one of the conductive materials listed above may be used independently, or any two or more of the conductive materials listed above may be used in combination. Examples of combinations of two or more conductive materials include alloys (specific examples include aluminum alloy, stainless steel, and brass). Of the conductive materials listed above, aluminum and an aluminum alloy are preferable.

The shape of the conductive substrate may be selected as appropriate to match the structure of an image forming apparatus in which the conductive substrate is to be used. The conductive substrate is for example a sheet-shaped conductive substrate or a drum-shaped conductive substrate. The thickness of the conductive substrate can be selected as appropriate in accordance with the shape of the conductive substrate.

[2. Photosensitive Layer]

{Charge Generating Layer}

The charge generating layer contains a charge generating material. The charge generating layer may contain a binder resin for the charge generating layer (also referred to below as a base resin) and various additives as necessary.

(Charge Generating Material)

No particular limitations are placed on the charge generating material other than being a charge generating material that can be used in the photosensitive member. Examples of charge generating materials include phthalocyanine-based pigments, perylene-based pigments, bisazo pigments, trisazo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. Any one of the charge generating materials listed above may be used independently, or any two or more of the charge generating materials listed above may be used in combination.

Examples of phthalocyanine-based pigments include metal-free phthalocyanine represented by chemical formula (C-1) shown below and metal phthalocyanine. Examples of metal phthalocyanine include titanyl phthalocyanine represented by chemical formula (C-2) shown below, hydroxygallium phthalocyanine, and chlorogallium phthalocyanine. The phthalocyanine-based pigments may be crystalline or non-crystalline. No particular limitations are placed on the crystal structure (for example, α-form, β-form, X-form, Y-form, V-form, and II-form) of the phthalocyanine-based pigments, and phthalocyanine-based pigments having various different crystal structures may be used.

(C-1)

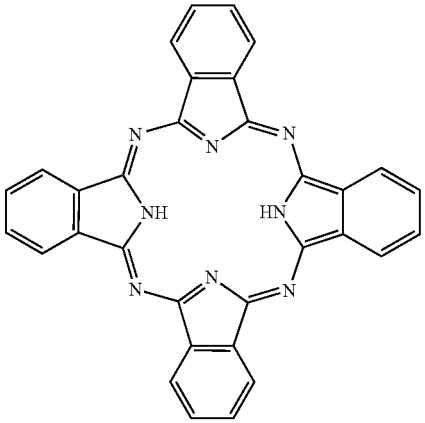

-continued (C-2)

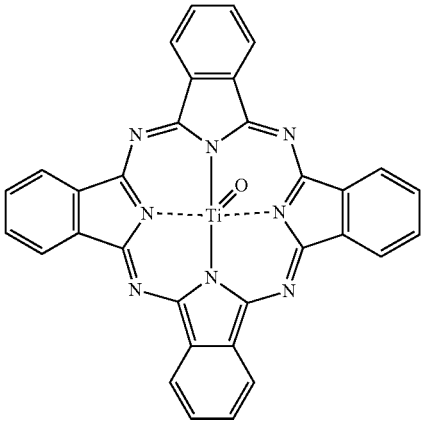

An example of crystalline metal-free phthalocyanine is metal-free phthalocyanine having an X-form crystal structure (also referred to below as X-form metal-free phthalocyanine). Examples of crystalline titanyl phthalocyanine include titanyl phthalocyanine having an α-form crystal structure, titanyl phthalocyanine having a β-form crystal structure, and titanyl phthalocyanine having a Y-form crystal structure (also referred to below as α-form titanyl phthalocyanine, β-form titanyl phthalocyanine, and Y-form titanyl phthalocyanine, respectively). Examples of crystalline hydroxygallium phthalocyanine include hydroxygallium phthalocyanine having a V-form crystal structure.

In a digital optical image forming apparatus (for example, a laser beam printer or facsimile machine that uses a light source such as a semiconductor laser), for example, a photosensitive member that is sensitive to a region of wavelengths of at least 700 nm is preferably used. In such a case, the charge generating material is preferably a phthalocyanine-based pigment as offering high quantum yield in the region of wavelengths of at least 700 nm, more preferably metal-free phthalocyanine or titanyl phthalocyanine, and still more preferably X-form metal-free phthalocyanine or Y-form titanyl phthalocyanine.

Y-form titanyl phthalocyanine for example exhibits a main peak at a Bragg angle (2θ±0.20) of 27.2° in a CuKα characteristic X-ray diffraction spectrum. The main peak in the CuKα characteristic X-ray diffraction spectrum refers to a peak having a highest or second highest intensity in a range of Bragg angles (2θ±0.2°) from 3° to 40°.

The following describes an example of a method for measuring the CuKα characteristic X-ray diffraction spectrum. A sample (titanyl phthalocyanine) is loaded into a sample holder of an X-ray diffraction spectrometer (for example, "RINT (registered Japanese trademark) 1100", product of Rigaku Corporation), and an X-ray diffraction spectrum is measured using a Cu X-ray tube, a tube voltage of 40 kV, a tube current of 30 mA, and CuKα characteristic X-rays having a wavelength of 1.542 Å. The measurement range (2θ) is for example from 30 to 40° (start angle: 3°, stop angle: 40°), and the scanning rate is for example 10°/minute.

The charge generating material is for example preferably contained in an amount of at least 5 parts by mass and no greater than 1,000 parts by mass relative to 100 parts by mass of the base resin contained in the charge generating material, and more preferably in an amount of at least 30 parts by mass and no greater than 500 parts by mass.

(Base Resin)

No particular limitations are placed on the base resin other than being a resin that can be used in the charge generating layer. Examples of base resins include thermoplastic resins, thermosetting resins, and photocurable resins. Examples of thermoplastic resins include styrene-butadiene copolymers, styrene-acrylonitrile copolymers, styrene-maleate copolymers, acrylic acid polymers, styrene-acrylate copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polysulfone resins, diallyl phthalate resins, ketone resins, polyvinyl acetal resins, polyvinyl butyral resins, polyether resins, polycarbonate resins, polyarylate resins, and polyester resins. Examples of thermosetting resins include silicone resins, epoxy resins, phenolic resins, urea resins, melamine resins, and other crosslinlable thermosetting resins. Examples of photocurable resins include epoxy-acrylate-based resins (acrylic acid adducts of epoxy compounds) and urethane-acrylate-based copolymers (acrylic acid adducts of urethane compounds). A polyvinyl acetal resin is preferably used as the base resin. Any one of the base resins listed above may be used independently, or any two or more of the base resins listed above may be used in combination.

The base resin is preferably a resin that is different from the binder resin described below. This is because in production of the photosensitive member, for example, an application liquid for charge transport layer formation is applied onto the charge generating layer, and it is preferable that the charge generating layer does not dissolve in a solvent of the application liquid for charge transport layer formation.

{Charge Transport Layer}

The charge transport layer contains a charge transport material, a binder resin, and a pigment that absorbs light having an irradiation wavelength. Examples of charge transport materials include hole transport materials. The charge transport layer may contain an electron acceptor compound and various additives as necessary.

(Hole Transport Material)

Examples of hole transport materials that can be used as the charge transport material include nitrogen-containing cyclic compounds and condensed polycyclic compounds. Examples of nitrogen-containing cyclic compounds and condensed polycyclic compounds include triphenylamine derivatives, diamine derivatives (specific examples include N,N,N',N'-tetraphenylbenzidine derivatives, N,N,N,N'-tetraphenylphenylenediamine derivatives, N,N,N',N'-tetraphenylnaphtylenediamine derivatives, di(aminophenylethenyl) benzene derivatives, and N,N,N',N'-tetraphenylphenanthrylenediamine derivatives), oxadiazole-based compounds (specific examples include 2,5-di(4-methylaminophenyl)-1,3,4-oxadiazole), styryl-based compounds (specific examples include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl) pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. Any one of the hole transport materials listed above may be used independently, or any two or more of the hole transport materials listed above may be used in combination.

In terms of efficient hole transport, the hole transport material is preferably contained in an amount of at least 10 parts by mass and no greater than 200 parts by mass relative to 100 parts by mass of the binder resin, and more preferably in an amount of at least 10 parts by mass and no greater than 100 parts by mass.

(Binder Resin)

The binder resin includes a polyarylate resin including a repeating unit represented by general formula (1) shown below (also referred to below as a polyarylate resin (1)). The charge transport layer may include one polyarylate resin (1) or may include two or more polyarylate resins (1).

(1)

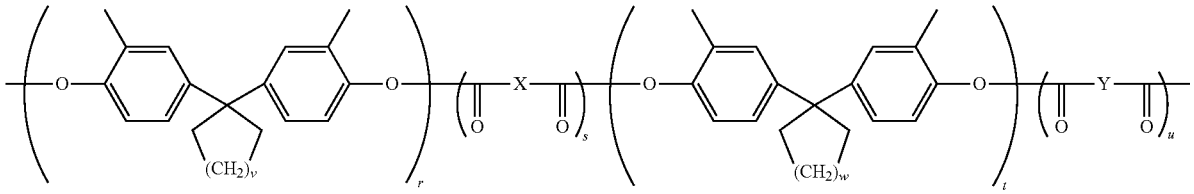

In general formula (1), v and w each represent, independently of one another, 2 or 3. r, s, t, and u each represent, independently of one another, a number greater than or equal to 0. r+s+t+u=100. r+t=s+u. r/(r+t) is at least 0.00 and no greater than 0.90. s/(s+u) is at least 0.00 and no greater than 0.90. X and Y each represent, independently of one another, a divalent group represented by chemical formula (1-1), chemical formula (1-2), chemical formula (1-3), or chemical formula (1-4) shown below.

(1-1)

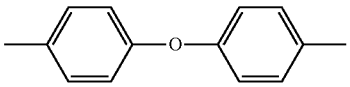

(1-2)

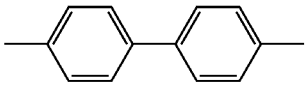

(1-3)

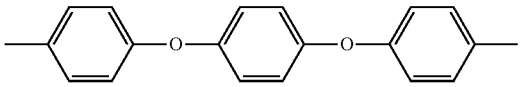

(1-4)

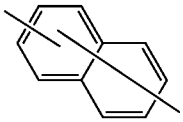

In general formula (1), preferably, v and w each represent 3 in terms of further improving the abrasion resistance. Preferably, r/(r+t) is at least 0.30 and no greater than 0.70 in terms of further improving the abrasion resistance. Preferably, s/(s+u) is at least 0.30 and no greater than 0.70 in terms of further improving the abrasion resistance.

In general formula (1), preferably, X and Y are different from one another in terms of further improving the abrasion resistance. In such a case, more preferably, X and Y each represent, independently of one another, a divalent group represented by chemical formula (1-1), chemical formula (1-2), or chemical formula (1-4) in terms of further improving the abrasion resistance. Particularly preferably, in terms of further improving the abrasion resistance, X is a divalent group represented by chemical formula (1-4) and Y is a divalent group represented by chemical formula (1-1) or chemical formula (1-2).

The polyarylate resin (1) for example includes a repeating unit represented by general formula (1-5) shown below (also referred to below as a repeating unit (1-5)), a repeating unit represented by general formula (1-6) shown below (also referred to below as a repeating unit (1-6)), a repeating unit represented by general formula (1-7) shown below (also referred to below as a repeating unit (1-7)), and a repeating unit represented by general formula (1-8) shown below (also referred to below as a repeating unit (1-8)).

(1-5)

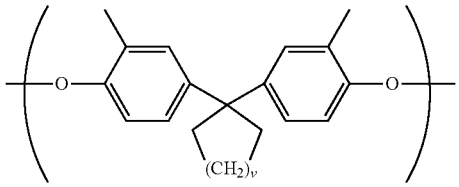

(1-6)

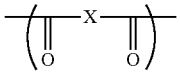

(1-7)

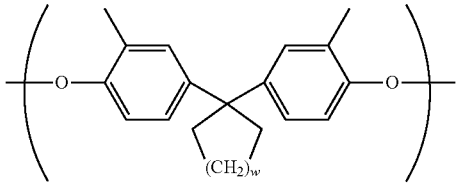

(1-8)

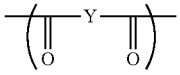

v in general formula (1-5), X in general formula (1-6), w in general formula (1-7), and Y in general formula (1-8) are respectively the same as defined for v, X, w, and Y in general formula (1).

The polyarylate resin (1) may include a repeating unit other than the repeating units (1-5) to (1-8). A ratio (mole fraction) of a sum of amounts by mole of the repeating units (1-5) to (1-8) to a total amount by mole of all repeating units in the polyarylate resin (1) is preferably at least 0.80, more preferably at least 0.90, and still more preferably 1.00.

No particular limitations are placed on the sequence of the repeating units (1-5) to (1-8) in the polyarylate resin (1) so long as a repeating unit derived from an aromatic diol and a repeating unit derived from an aromatic dicarboxylic acid are adjacent to one another. For example, the repeating unit (1-5) is adjacent to and bonded to the repeating unit (1-6) or the repeating unit (1-8). Likewise, the repeating unit (1-7) is adjacent to and bonded to the repeating unit (1-6) or the repeating unit (1-8).

In general formula (1), r represents a percentage of the number of repeating units (1-5) relative to a sum of the number of repeating units (1-5), the number of repeating units (1-6), the number of repeating units (1-7), and the number of repeating units (1-8) in the polyarylate resin (1). s represents a percentage of the number of repeating units (1-6) relative to the sum of the number of repeating units (1-5), the number of repeating units (1-6), the number of repeating units (1-7), and the number of repeating units (1-8) in the polyarylate resin (1). t represents a percentage of the number of repeating units (1-7) relative to the sum of the number of repeating units (1-5), the number of repeating units (1-6), the number of repeating units (1-7), and the number of repeating units (1-8) in the polyarylate resin (1). u represents a percentage of the number of repeating units (1-8) relative to the sum of the number of repeating units (1-5), the number of repeating units (1-6), the number of repeating units (1-7), and the number of repeating units (1-8) in the polyarylate resin (1). Note that each of r s, t, and u is not a value obtained from one resin chain but a number average obtained from all molecules of the polyarylate resin (1) (a plurality of resin chains) contained in the charge transport layer.

The binder resin may include only the polyarylate resin (1) or may include the polyarylate resin (1) and a resin (an additional resin) other than the polyarylate resin (1) in combination. Examples of additional resins include thermoplastic resins (specific examples include polyarylate resins other than the polyarylate resin (1), polycarbonate resins, styrene-based resins, styrene-butadiene copolymers, styrene-acrylonitrile copolymers, styrene-maleate copolymers, styrene-acrylate copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, polyester resins, alkyd resins, polyamide resins, polyurethane resins, polysulfone resins, diallyl phthalate resins, ketone resins, polyvinyl butyral resins, polyether resins, and polyester resins), thermosetting resins (specific examples include silicone resins, epoxy resins, phenolic resins, urea resins, melamine resins, and other crosslinkable thermosetting resins), and photocurable resins (specific examples include epoxy-acrylate-based resins and urethane-acrylate-based copolymers). The binder resin may include only one of the additional resins listed above or may include any two or more of the additional resins listed above. The amount of the polyarylate resin (1) preferably accounts for at least 80% by mass of a total amount of the binder resin, more preferably at least 90% by mass of the total amount of the binder resin, and still more preferably 100% by mass of the total amount of the binder resin.

In terms of further improving the abrasion resistance, the binder resin preferably has a viscosity average molecular weight of at least 10,000, more preferably at least 20,000, still more preferably at least 30,000, and particularly preferably at least 40,000. The binder resin preferably has a viscosity average molecular weight of no greater than 80,000, and more preferably no greater than 55,000. As a result of the viscosity average molecular weight of the binder resin being no greater than 80,000, the binder resin tends to readily dissolve in a solvent during formation of the charge transport layer, facilitating the formation of the charge transport layer.

No particular limitations are placed on a method for preparing the binder resin so long as the method enables production of the polyarylate resin (1). Examples of methods for preparing the binder resin include a method involving polycondensation of an aromatic diol and an aromatic dicarboxylic acid for forming repeating units of the polyarylate resin (1). No particular limitations are placed on the method for polycondensation of an aromatic diol and an aromatic dicarboxylic acid, and any known synthesis method (specific examples include solution polymerization, melt polymerization, and interfacial polymerization) can be employed.

The aromatic dicarboxylic acid that is used in preparation of the polyarylate resin (1) has two carboxyl groups and is represented by chemical formula (1-9) shown below or general formula (1-10) shown below. X in general formula (1-9) and Y in general formula (1-10) are respectively the same as defined for X and Y in general formula (1).

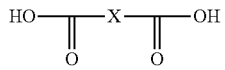

(1-9)

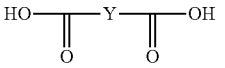

(1-10)

Examples of aromatic dicarboxylic acids include an aromatic dicarboxylic acid having an aromatic ring and two carboxyl groups bonded to the aromatic ring (specific examples include 4,4'-di carboxydiphenyl ether and 4,4'-dicarboxybiphenyl). Derivatives of the aromatic dicarboxylic acid such as diacid dichlorides, dimethyl esters, and diethyl esters may alternatively be used. Furthermore, the aromatic dicarboxylic acid that is used in the polycondensation may include an aromatic dicarboxylic acid other than the aromatic dicarboxylic acids represented by chemical formula (1-9) and general formula (1-10).

The aromatic diol has two phenolic hydroxyl groups and is represented by general formula (1-11) shown below or chemical formula (1-12) shown below. v in general formula (1-11) and w in general formula (1-12) are respectively the same as defined for v and w in general formula (1).

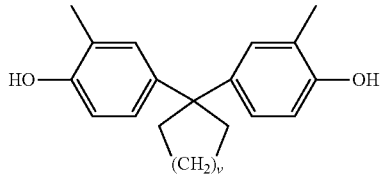

(1-11)

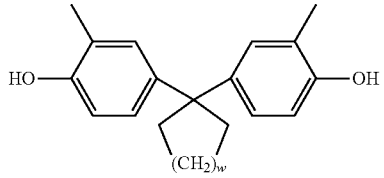

(1-12)

Derivatives of the aromatic diol such as diacetates may be used for synthesis of the polyarylate resin (1). Furthermore, the aromatic diol that is used in the polycondensation may include an aromatic diol other than the aromatic diols represented by general formula (1-11) and general formula (1-12).

The polyarylate resin (1) is for example any of polyarylate resins represented by chemical formulae (R-1) to (R-6) shown below (also referred to below as polyarylate resins (R-1) to (R-6), respectively).

(R-1)

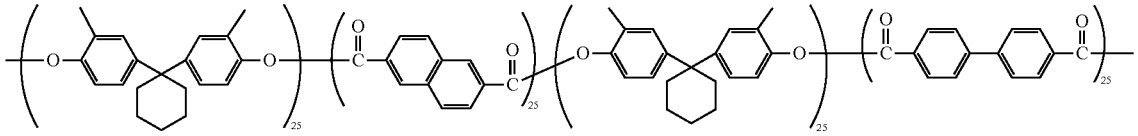

(R-2)

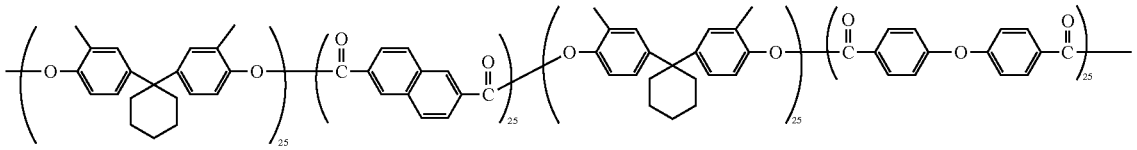

(R-3)

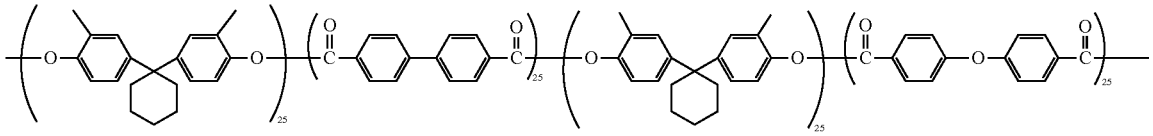

(R-4)

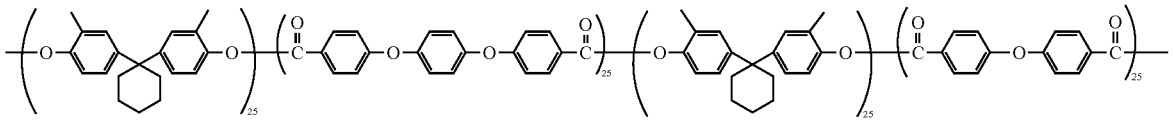

(R-5)

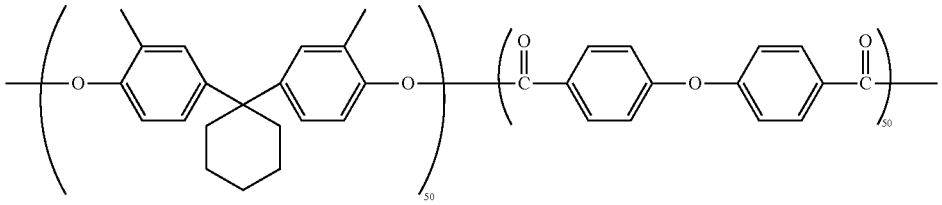

(R-6)

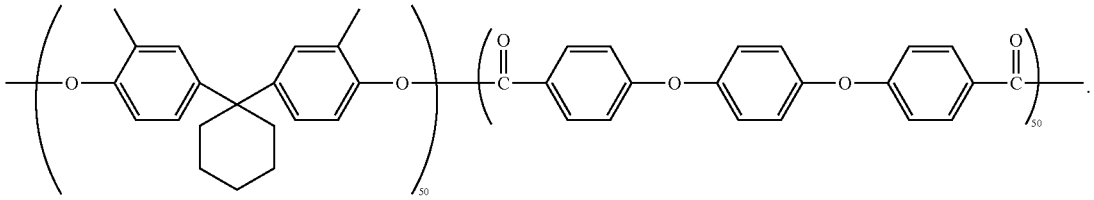

Of the polyarylate resins (R-1) to (R-6), in terms of further improving the abrasion resistance, the polyarylate resins (R-1), (R-2), and (R-3) are preferable, and the polyarylate resins (R-1) and (R-2) are more preferable.

(Pigment A)

The charge transport layer contains a pigment represented by general formula (2) or general formula (3) shown below (also referred to below as a pigment A) as the pigment that absorbs light having an irradiation wavelength. The irradiation wavelength is selected as appropriate according to an image forming apparatus to be used and is for example within a range of from 700 nm to 850 nm.

The pigment A is a naphthalocyanine compound represented by general formula (2) shown below (also referred to below as a naphthalocyanine compound (2)) or a naphthalocyanine compound represented by general formula (3) shown below (also referred to below as a naphthalocyanine compound (3)). The charge transport layer contains one compound, or two or more compounds out of the naphthalocyanine compounds (2) and (3).

(2)

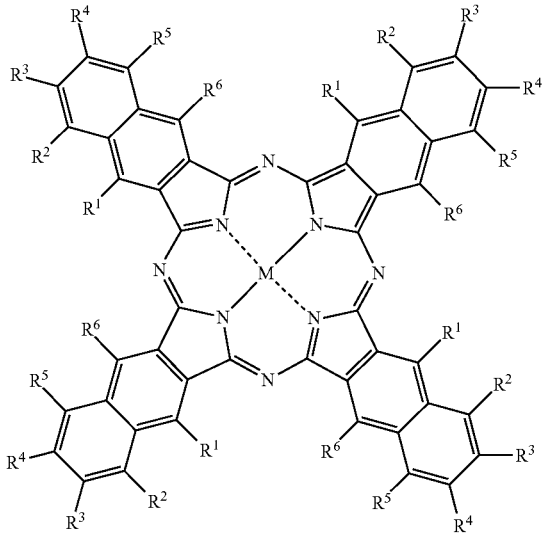

In general formula (2), $R^1$, $R^2$, $R^3$, $R^4$, $R^5$, and $R^6$ each represent, independently of one another, a hydrogen atom, an alkyl group optionally having a substituent and having a carbon number of at least 1 and no greater than 6, an aryl group optionally having a substituent and having a carbon number of at least 6 and no greater than 14, an alkoxy group optionally having a substituent and having a carbon number of at least 1 and no greater than 6, a phenoxy group optionally having a substituent, a thioalkyl group optionally having a substituent and having a carbon number of at least 1 and no greater than 6, or a thiophenyl group optionally having a substituent, with the proviso that $R^1$, $R^2$, $R^3$, $R^4$, $R^5$, and $R^6$ do not all simultaneously represent hydrogen atoms. M represents a metal atom optionally having a ligand.

(3)

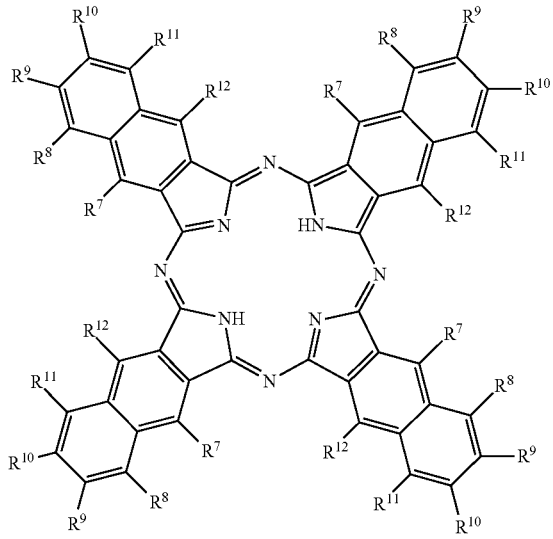

In general formula (3), $R^7$, $R^8$, $R^9$, $R^{10}$, $R^{11}$, and $R^{12}$ each represent, independently of one another, a hydrogen atom, an alkyl group optionally having a substituent and having a carbon number of at least 1 and no greater than 6, an aryl group optionally having a substituent and having a carbon number of at least 6 and no greater than 14, an alkoxy group optionally having a substituent and having a carbon number of at least 1 and no greater than 6, a phenoxy group optionally having a substituent, a thioalkyl group optionally having a substituent and having a carbon number of at least 1 and no greater than 6, or a thiophenyl group optionally having a substituent, with the proviso that $R^7$, $R^8$, $R^9$, $R^{10}$, $R^{11}$, and $R^{12}$ do not all simultaneously represent hydrogen atoms.

The photosensitive member according to the present embodiment is excellent in abrasion resistance because of the charge transport layer thereof containing the pigment A and the polyarylate resin (1) described above. The reason for the above is thought to be as follows.

The charge transport layer tends to have an increased layer density due to an interaction between the polyarylate resin (1) and the pigment A that occurs in an application liquid for charge transport layer formation during the formation of the charge transport layer. This is thought to be why the photosensitive member according to the present embodiment is excellent in abrasion resistance.

The photosensitive member according to the present embodiment is capable of inhibiting reduction of its electrical characteristics due to a decrease in thickness of the photosensitive layer. The reason for the above is thought to be as follows.

Exposing the photosensitive member to light causes charge (hole and electron) generation in the charge generating layer. Holes from the thus generated charge travel from the charge generating layer to the charge transport layer. Exposing the photosensitive member to light also causes charge (hole and electron) generation from the pigment A in the charge transport layer. The charge (holes and electrons) generated from the pigment A facilitates traveling of the holes generated in the charge generating layer to the charge transport layer. This is thought to be why the photosensitive member can maintain its electrical characteristics even if the thickness of the photosensitive layer decreases through repeated use. The amount of the pigment A in the charge transport layer decreases as the thickness of the photosensitive layer decreases. As a result, the charge transport layer allows more exposure light to pass therethrough, so that charge can be efficiently generated in the charge generating layer. This is thought to be why the photosensitive member according to the present embodiment is capable of inhibiting reduction of its electrical characteristics due to a decrease in thickness of the photosensitive layer.

In general formulae (2) and (3), the alkyl group having a carbon number of at least 1 and no greater than 6 that may be represented by $R^1$, $R^2$, $R^3$, $R^4$, $R^5$, $R^6$, $R^7$, $R^8$, $R^9$, $R^{10}$, $R^{11}$, and $R^{12}$ is an alkyl group optionally having a substituent. Examples of possible substituents include an aryl group having a carbon number of at least 6 and no greater than 14, an alkoxy group having a carbon number of at least 1 and no greater than 6, a phenoxy group, a thioalkyl group having a carbon number of at least 1 and no greater than 6, and a thiophenyl group.

In general formulae (2) and (3), the aryl group having a carbon number of at least 6 and no greater than 14 that may be represented by $R^1$, $R^2$, $R^3$, $R^4$, $R^5$, $R^6$, $R^7$, $R^8$, $R^9$, $R^{10}$, $R^{11}$, and $R^{12}$ is an aryl group optionally having a substituent. Examples of possible substituents include an alkyl group having a carbon number of at least 1 and no greater than 6, an aryl group having a carbon number of at least 6 and no greater than 14, an alkoxy group having a carbon number of at least 1 and no greater than 6, a phenoxy group, a thioalkyl group having a carbon number of at least 1 and no greater than 6, and a thiophenyl group.

In general formulae (2) and (3), the alkoxy group having a carbon number of at least 1 and no greater than 6 that may be represented by $R^1$, $R^2$, $R^3$, $R^4$, $R^5$, $R^6$, $R^7$, $R^8$, $R^9$, $R^{10}$, $R^{11}$, and $R^{12}$ is an alkoxy group optionally having a substituent. Examples of possible substituents include an aryl group having a carbon number of at least 6 and no greater than 14, an alkoxy group having a carbon number of at least 1 and no greater than 6, a phenoxy group, a thioalkyl group having a carbon number of at least 1 and no greater than 6, and a thiophenyl group.

In general formulae (2) and (3), the phenoxy group that may be represented by $R^1$, $R^2$, $R^3$, $R^4$, $R^5$, $R^6$, $R^7$, $R^8$, $R^9$, $R^{10}$, $R^{11}$, and $R^{12}$ is a phenoxy group optionally having a substituent. Examples of possible substituents include an alkyl group having a carbon number of at least 1 and no greater than 6, an aryl group having a carbon number of at least 6 and no greater than 14, an alkoxy group having a carbon number of at least 1 and no greater than 6, a phenoxy group, a thioalkyl group having a carbon number of at least 1 and no greater than 6, and a thiophenyl group.

In general formulae (2) and (3), the thioalkyl group having a carbon number of at least 1 and no greater than 6 that may be represented by $R^1$, $R^2$, $R^3$, $R^4$, $R^5$, $R^6$, $R^7$, $R^8$, $R^9$, $R^{10}$, $R^{11}$, and $R^{12}$ is a thioalkyl group optionally having a substituent. Examples of possible substituents include an aryl group having a carbon number of at least 6 and no greater than 14, an alkoxy group having a carbon number of at least 1 and no greater than 6, a phenoxy group, a thioalkyl group having a carbon number of at least 1 and no greater than 6, and a thiophenyl group.

In general formulae (2) and (3), the thiophenyl group that may be represented $R^1$, $R^2$, $R^3$, $R^4$, $R^5$, $R^6$, $R^7$, $R^8$, $R^9$, $R^{10}$, $R^{11}$, and $R^{12}$ is a thiophenyl group optionally having a substituent. Examples of possible substituents include an alkyl group having a carbon number of at least 1 and no greater than 6, an aryl group having a carbon number of at least 6 and no greater than 14, an alkoxy group having a carbon number of at least 1 and no greater than 6, a phenoxy group, a thioalkyl group having a carbon number of at least 1 and no greater than 6, and a thiophenyl group.

In general formula (2), the metal atom that may be represented by M is a metal atom optionally having a ligand. Examples of possible ligands include an alkyl group optionally having a substituent and having a carbon number of at least 1 and no greater than 6, an alkoxy group optionally having a substituent and having a carbon number of at least 1 and no greater than 6, an aryloxy group optionally having a substituent and having a carbon number of at least 6 and no greater than 14, a halogen atom, a hydroxyl group, and an oxo group (=O). When the metal atom is coordinated with a ligand other than an oxo group among the ligands listed above, the metal atom may be coordinated with two ligands. The ligand optionally has a substituent, and examples of possible substituents are the same as those listed for $R^1$, $R^2$, $R^3$, $R^4$, $R^5$, $R^6$, $R^7$, $R^8$, $R^9$, $R^{10}$, $R^{11}$, and $R^{12}$ above.

In terms of further inhibiting reduction of the electrical characteristics due to a decrease in thickness of the photosensitive layer, preferably, $R^1$ and $R^6$ in general formula (2) each represent, independently of one another, a hydrogen atom, an alkyl group optionally having a substituent and having a carbon number of at least 1 and no greater than 6, or an alkoxy group optionally having a substituent and having a carbon number of at least 1 and no greater than 6, more preferably a hydrogen atom or an alkoxy group having a carbon number of at least 1 and no greater than 6, still more preferably a hydrogen atom or an alkoxy group having a carbon number of at least 1 and no greater than 4, and particularly preferably a hydrogen atom or an n-butoxy group.

In terms of further inhibiting reduction of the electrical characteristics due to a decrease in thickness of the photosensitive layer, preferably, $R^2$, $R^3$, and $R^5$ in general formula (2) each represent, independently of one another, a hydrogen atom, an alkyl group optionally having a substituent and having a carbon number of at least 1 and no greater than 6, or an alkoxy group optionally having a substituent and having a carbon number of at least 1 and no greater than 6, and more preferably a hydrogen atom.

In terms of further inhibiting reduction of the electrical characteristics due to a decrease in thickness of the photosensitive layer, preferably, R in general formula (2) represents a hydrogen atom, an alkyl group optionally having a substituent and having a carbon number of at least 1 and no greater than 6, or an alkoxy group optionally having a substituent and having a carbon number of at least 1 and no greater than 6, more preferably a hydrogen atom or an alkyl group having a carbon number of at least 1 and no greater than 6, still more preferably a hydrogen atom or an alkyl group having a carbon number of at least 1 and no greater than 4, and particularly preferably a hydrogen atom or a t-butyl group.

In terms of further inhibiting reduction of the electrical characteristics due to a decrease in thickness of the photosensitive layer, preferably, M in general formula (2) represents a copper atom optionally having a ligand, a zinc atom optionally having a ligand, or a vanadium atom optionally having a ligand, and more preferably a copper atom having no ligand, a zinc having no ligand, or a vanadium atom having an oxo group as a ligand.

In terms of further inhibiting reduction of the electrical characteristics due to a decrease in thickness of the photosensitive layer, preferably, $R^7$ and $R^{12}$ in general formula (3) each represent, independently of one another, a hydrogen atom, an alkyl group optionally having a substituent and having a carbon number of at least 1 and no greater than 6, or an alkoxy group optionally having a substituent and having a carbon number of at least 1 and no greater than 6, more preferably a hydrogen atom or an alkoxy group having a carbon number of at least 1 and no greater than 6, still more preferably a hydrogen atom or an alkoxy group having a carbon number of at least 1 and no greater than 4, further preferably a hydrogen atom or an n-butoxy group, and particularly preferably a hydrogen atom.

In terms of further inhibiting reduction of the electrical characteristics due to a decrease in thickness of the photosensitive layer, preferably, $R^8$, $R^9$, and $R^{11}$ in general formula (3) each represent, independently of one another, a hydrogen atom, an alkyl group optionally having a substituent and having a carbon number of at least 1 and no greater than 6, or an alkoxy group optionally having a substituent and having a carbon number of at least 1 and no greater than 6, and more preferably a hydrogen atom.

In terms of further inhibiting reduction of the electrical characteristics due to a decrease in thickness of the photosensitive layer, preferably, $R^{10}$ in general formula (3) represents a hydrogen atom, an alkyl group optionally having a substituent and having a carbon number of at least 1 and no greater than 6, or an alkoxy group optionally having a substituent and having a carbon number of at least 1 and no greater than 6, more preferably a hydrogen atom or an alkyl group having a carbon number of at least 1 and no greater than 6, still more preferably an alkyl group having a carbon number of at least 1 and no greater than 6, further preferably an alkyl group having a carbon number of at least 1 and no greater than 4, and particularly preferably a t-butyl group.

The pigment A is for example any of pigments represented by chemical formulae (D-1) to (D-5) (also referred to below as pigments (D-1) to (D-5), respectively).

(D-1)

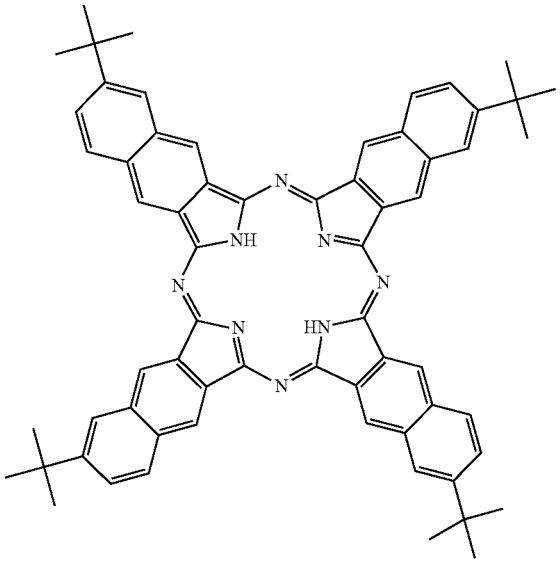

(D-2)

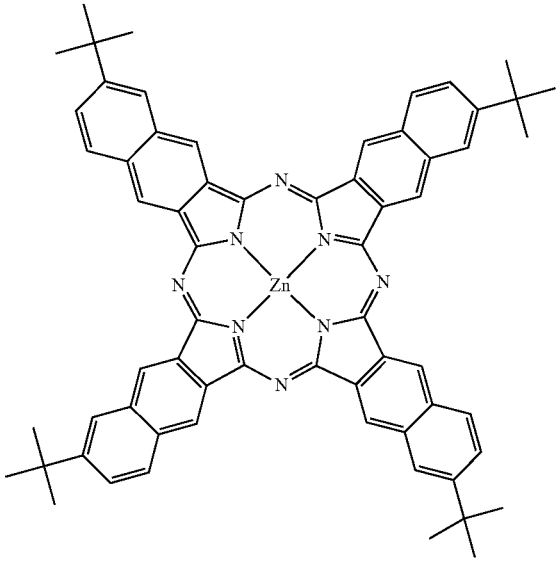

-continued (D-3)

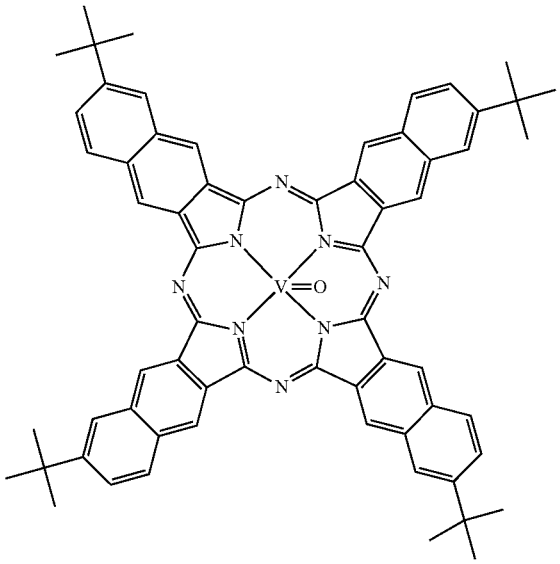

(D-4)

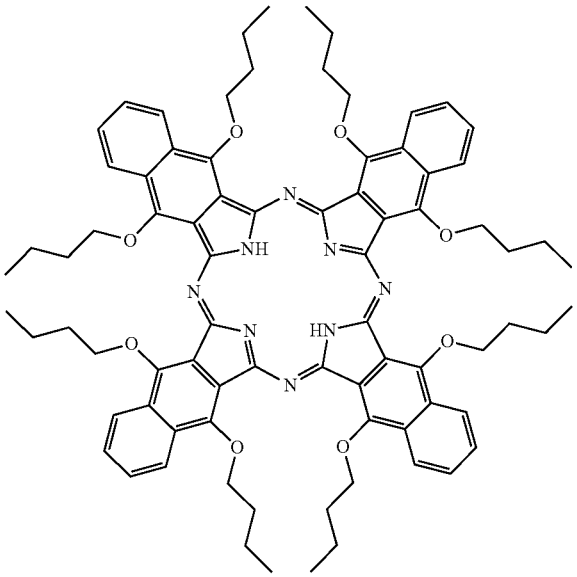

-continued (D-5)

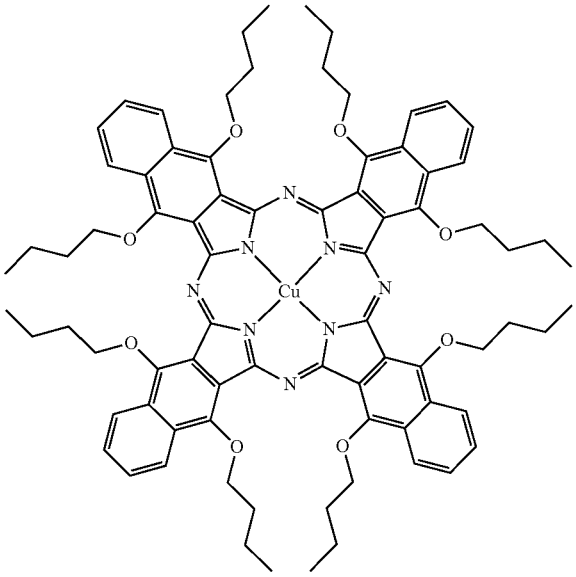

In terms of achieving higher solubility in a solvent in the formation of the charge transport layer, the pigment A is preferably an uncrystallized pigment.

In terms of further improving the abrasion resistance and further inhibiting reduction of the electrical characteristics due to a decrease in thickness of the photosensitive layer, the pigment A is preferably contained in an amount of at least 0.05 parts by mass relative to 100.00 parts by mass of the binder resin, and more preferably in an amount of at least 0.10 parts by mass. In terms of further improving the abrasion resistance and further inhibiting reduction of the electrical characteristics due to a decrease in thickness of the photosensitive layer, the pigment A is preferably contained in an amount of no greater than 3.00 parts by mass relative to 100.00 parts by mass of the binder resin, more preferably in an amount of no greater than 1.00 part by mass, and still more preferably in an amount of no greater than 0.60 parts by mass.

(Electron Acceptor Compound)

The charge transport layer may contain an electron acceptor compound as necessary. The electron acceptor compound tends to improve charge transporting ability of the charge transport material.

Examples of electron acceptor compounds include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include diphenoquinone-based compounds, azoquinone-based compounds, anthraquinone-based compounds, naphthoquinone-based compounds, nitroanthraquinone-based compounds, and dinitroanthraquinone-based compounds. Any one of the electron acceptor compounds listed above may be used independently, or any two or more of the electron acceptor compounds listed above may be used in combination, (Additive)

The charge transport layer may contain an additive as necessary. Examples of additives include antidegradants (specific examples include antioxidants, radical scavengers, quenchers, and ultraviolet absorbing agents), softeners, surface modifiers, extenders, thickeners, dispersion stabilizers, waxes, donors, surfactants, and leveling agents.

Examples of antioxidants include hindered phenol compounds, hindered amine compounds, thioether compounds, and phosphite compounds. Of the antioxidants listed above, hindered phenol compounds and hindered amine compounds are preferable.

The charge transport layer preferably has a transmittance of at least 5% and less than 80% for light having an irradiation wavelength, and more preferably at least 10% and no greater than 75%. Through the charge transport layer having a transmittance of at least 5%, reduction of the amount of charge that is generated in the charge generating layer can be inhibited. Through the charge transport layer having a transmittance of less than 80%, reduction of the electrical characteristics due to a decrease in thickness of the photosensitive layer can be further inhibited. A method for measuring the transmittance will be described in detail in association with Examples. The transmittance can be controlled by changing the type and the amount of the pigment A.

(Combination of Materials)

In order to further improve the abrasion resistance and further inhibit reduction of the electrical characteristics due to a decrease in thickness of the photosensitive layer, preferably, the binder resin and the pigment are any of combination examples 1 to 10 shown in Table 1 below. For the same reason, more preferably, the binder resin and the pigment are any of the combination examples 1 to 10 shown in Table 1 below, and the hole transport material is a hole transport material (HTM-1). For the same reason, more preferably, the binder resin and the pigment are any of the combination examples 1 to 10 shown in Table 1 below, and the charge generating material is Y-form titanyl phthalocyanine. For the same reason, still more preferably, the binder resin and the pigment are any of the combination examples 1 to 10 shown in Table 1 below, the hole transport material is the hole transport material (HTM-1), and the charge generating material is Y-form titanyl phthalocyanine. Note that the hole transport material (HTM-1) will be described in association with Examples below.

TABLE 1

| | Binder resin | Pigment |
|---|---|---|
| Combination example 1 | Polyarylate resin (R-1) | Pigment (D-1) |
| Combination example 2 | Polyarylate resin (R-1) | Pigment (D-2) |
| Combination example 3 | Polyarylate resin (R-1) | Pigment (D-3) |
| Combination example 4 | Polyarylate resin (R-1) | Pigment (D-4) |
| Combination example 5 | Polyarylate resin (R-1) | Pigment (D-5) |
| Combination example 6 | Polyarylate resin (R-2) | Pigment (D-1) |
| Combination example 7 | Polyarylate resin (R-3) | Pigment (D-1) |
| Combination example 8 | Polyarylate resin (R-4) | Pigment (D-1) |
| Combination example 9 | Polyarylate resin (R-5) | Pigment (D-1) |
| Combination example 10 | Polyarylate resin (R-6) | Pigment (D-1) |

[3. Intermediate Layer]

The photosensitive member according to the first embodiment may have an intermediate layer (for example, an undercoat layer). The intermediate layer for example contains inorganic particles and a resin that is used for the intermediate layer (intermediate layer resin). Provision of the intermediate layer can facilitate flow of current generated when the photosensitive member is exposed to light and inhibit increasing electric resistance, while also maintaining insulation to a sufficient degree so as to inhibit occurrence of leakage current.

Examples of inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). Any one type of the inorganic particles listed above may be used independently, or any two or more types of the inorganic particles listed above may be used in combination. Note that the inorganic particles may be surface-treated.

No particular limitations are placed on the intermediate layer resin other than being a resin that can be used to form the intermediate layer

[4. Photosensitive Member Production Method]

No particular limitations are placed on the method for producing the photosensitive member according to the present embodiment other than including a photosensitive layer formation step. The photosensitive layer formation step for example includes a charge generating layer formation step and a charge transport layer formation step.

In the charge generating layer formation step, first, an application liquid for charge generating layer formation is prepared. Next, the application liquid for charge generating layer formation is applied onto a conductive substrate. Next, drying is performed by an appropriate method to remove at least a portion of a solvent in the applied application liquid for charge generating layer formation to form a charge generating layer. The application liquid for charge generating layer formation for example contains a charge generating material, a base resin, and a solvent. Such an application liquid for charge generating layer formation can be prepared by dissolving or dispersing the charge generating material and the base resin in the solvent. Various additives may be added to the application liquid for charge generating layer formation as necessary.

In the charge transport layer formation step, first, an application liquid for charge transport layer formation is prepared. Next, the application liquid for charge transport layer formation is applied onto the charge generating layer. Next, drying is performed by an appropriate method to remove at least a portion of a solvent in the applied application liquid for charge transport layer formation to form a charge transport layer. The application liquid for charge transport layer formation for example contains a charge transport material, the polyarylate resin (1) as a binder resin, the pigment A, and a solvent. Such an application liquid for charge transport layer formation can be prepared by dissolving or dispersing the charge transport material, the polyarylate resin (1), and the pigment A in the solvent. An electron acceptor compound and various additives may be added to the application liquid for charge transport layer formation as necessary.

The following describes the photosensitive layer formation step in detail. No particular limitations are placed on the respective solvents contained in the application liquid for charge generating layer formation and the application liquid for charge transport layer formation (also referred to below generically as application liquids) other than that the components of each of the application liquids should be soluble or dispersible in the solvent. Examples of solvents include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used independently, or any two or more of the solvents listed above may be used in combination. Of the solvents listed above, a non-halogenated solvent is preferably used.

Each application liquid is prepared by dispersing the components in the solvent by mixing. Mixing or dispersion can for example be performed using a bead mill, a roll mill, a ball mill, an attritor, a paint shaker, or an ultrasonic disperser.

Each application liquid may for example contain a surfactant in order to improve dispersibility of the components.

No particular limitations are placed on the method by which each application liquid is applied other than being a method that enables uniform application of the application liquid. Examples of application methods include dip coating, spray coating, spin coating, and bar coating.

No particular limitations are placed on the method by which at least a portion of the solvent in each application liquid is removed other than being a method that enables evaporation of at least a portion of the solvent in the application liquid. Examples of removal methods include heating, pressure reduction, and a combination of heating and pressure reduction. Specific examples thereof include heat treatment (hot-air drying) using a high-temperature dryer or a reduced-pressure dryer. The heat treatment is for example performed for at least 3 minutes and no greater than 120 minutes at a temperature of at least 40° C. and no greater than 150° C.

The method for producing the photosensitive member may further include another step such as an intermediate layer formation step as necessary. The intermediate layer formation step may be performed by a method appropriately selected from known methods.

The photosensitive member according to the present embodiment described above is excellent in abrasion resistance and is capable of inhibiting reduction of its electrical characteristics due to a decrease in thickness of the photosensitive layer. The photosensitive member can therefore be suitably used in various image forming apparatuses.

Second Embodiment: Image Forming Apparatus

The following describes an image forming apparatus according to a second embodiment. The image forming apparatus according to the second embodiment includes an image bearing member, a charger, a light exposure section, a developing section, and a transfer section. The image bearing member is the photosensitive member according to the first embodiment described above. The charger charges a surface of the image bearing member. The light exposure section exposes the charged surface of the image bearing member to light to form an electrostatic latent image on the surface of the image bearing member. The developing section develops the electrostatic latent image into a toner image. The transfer section transfers the toner image from the image bearing member to a transfer target.

The image forming apparatus according to the second embodiment can offer a lower running cost. The reason for the above is thought to be as follows. The image forming apparatus according to the second embodiment includes the photosensitive member according to the first embodiment as the image bearing member. The photosensitive member according to the first embodiment is excellent in abrasion resistance and is capable of inhibiting reduction of its electrical characteristics due to a decrease in thickness of the photosensitive layer. Thus, frequency of photosensitive member replacement in the image forming apparatus according to the second embodiment can be reduced, offering a lower running cost.

Figure 3:
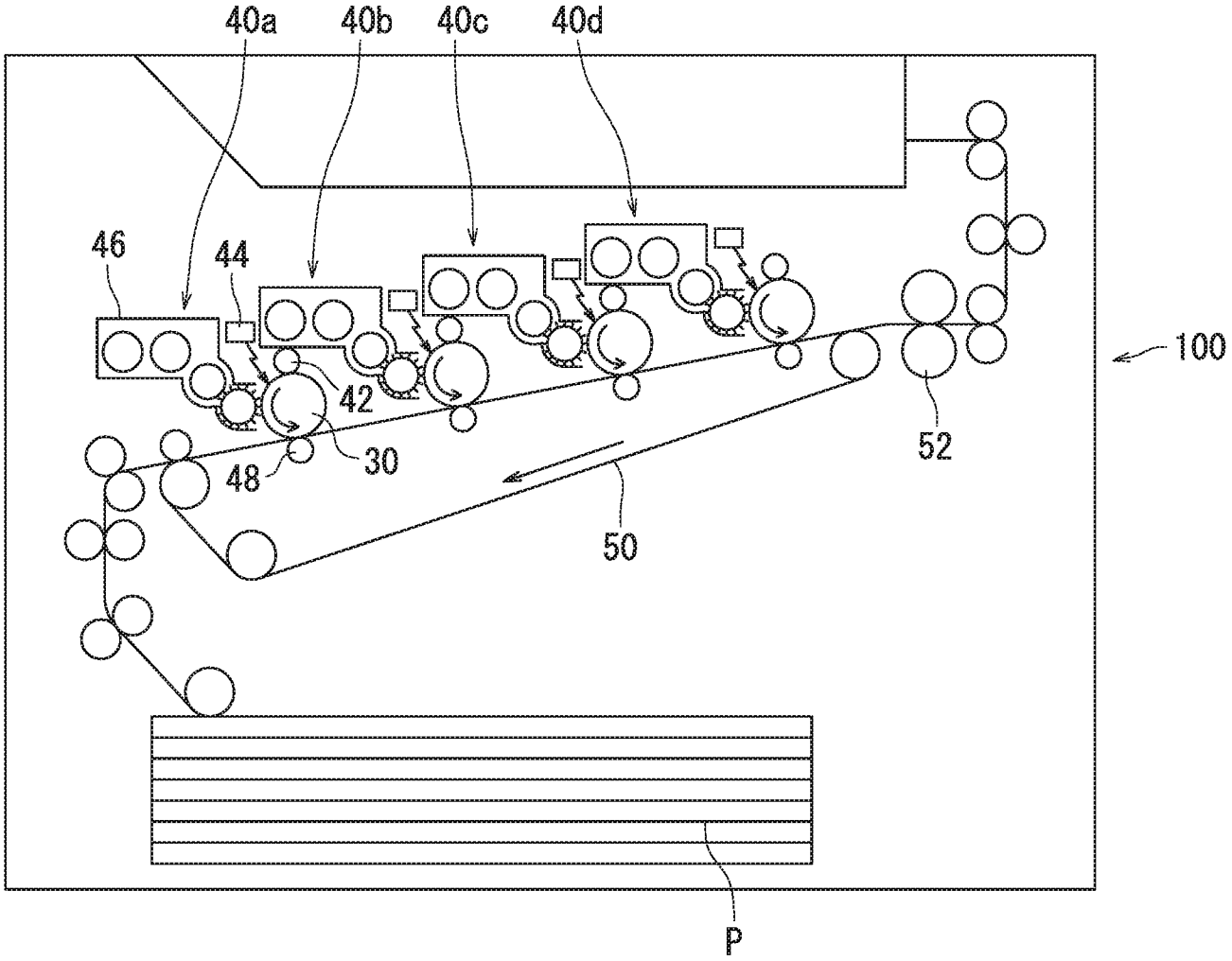
FIG. 3 is a diagram illustrating an example of an image forming apparatus according to a second embodiment of the present invention.

The following describes one form of the image forming apparatus according to the second embodiment using a tandem color image forming apparatus as an example with reference to FIG. 3.

An image forming apparatus 100 illustrated in FIG. 3 includes image formation units 40*a*, 40*b*, 40*c*, and 40*d*, a transfer belt 50, and a fixing section 52. Hereinafter, the image formation units 40*a*, 40*b*, 40*c*, and 40*d* are each referred to as an image formation unit 40 unless they need to be distinguished from one another.

The image formation unit 40 includes an image bearing member 30, a charger 42, a light exposure section 44, a developing section 46, and a transfer section 48. The image bearing member 30 is disposed at a center of the image formation unit 40. The image bearing member 30 is rotatable in a direction indicated by an arrow (counterclockwise). Around the image bearing member 30, the charger 42, the light exposure section 44, the developing section 46, and the transfer section 48 are arranged in the stated order from upstream to downstream in a rotation direction of the image bearing member 30 relative to the charger 42 as a reference point. The image formation unit 40 may further include either or both of a cleaning section (not shown) and a static eliminating section (not shown).

The image formation units 40*a* to 40*d* superimpose toner images of a plurality of colors (for example, four colors of black, cyan, magenta, and yellow) on one another in order on a recording medium P (transfer target) on the transfer belt 50.

The charger 42 is a charging roller. The charging roller charges the surface of the image bearing member 30 while in contact with the surface of the image bearing member 30. An image forming apparatus including a charging roller typically tends to have a higher running cost, because an image bearing member therein is abraded through repeated use. However, the image forming apparatus 100 includes the photosensitive member according to the first embodiment as the image bearing member 30. The photosensitive member according to the first embodiment is excellent in abrasion resistance and is capable of inhibiting reduction of its electrical characteristics due to a decrease in thickness of the photosensitive layer. The image forming apparatus 100 can therefore offer a lower running cost even though the image forming apparatus 100 includes a charging roller as the charger 42, As described above, the image forming apparatus 100, which is an example of the second embodiment, adopts a contact charging process. Examples of other contact chargers include a charging brush. Note that the charger may be a non-contact charger. Examples of non-contact chargers include a corotron charger or a scorotron charger.

No particular limitations are placed on voltage to be applied by the charger 42. The charger 42 for example applies a direct current voltage, an alternating current voltage, or a composite voltage (a voltage of an alternating current voltage superimposed on a direct current voltage), among which a direct current voltage is preferable. A direct current voltage has the following advantages compared to an alternating current voltage and a composite voltage. In a configuration in which the charger 42 only applies a direct current voltage, the value of voltage applied to the image bearing member 30 is constant, and therefore it is easy to uniformly charge the surface of the image bearing member 30 to a specified potential. The amount of abrasion of the photosensitive layer tends to be smaller in a configuration in which the charger 42 only applies a direct current voltage. As a result, favorable images can be formed.

The light exposure section 44 exposes the charged surface of the image bearing member 30 to light. Through the above, an electrostatic latent image is formed on the surface of the image bearing member 30. A portion of inrradiation light (exposure light) to which the surface of the image beating member 30 is exposed by the light exposure section 44 is absorbed by the pigment A in the image bearing member 30, which is the photosensitive member according to the first embodiment described above. The electrostatic latent image is formed based on image data input to the image formnning apparatus 100.

The developing section 46 supplies a toner to the surface of the image bearing member 30 to develop the electrostatic latent image into a toner image. The developing section 46 may also function as a cleaning section that cleans the surface of the image bearing member 30.

The transfer belt 50 conveys the recording medium P to a location between the image bearing member 30 and the transfer section 48. The transfer belt 50 is an endless belt. The transfer belt 50 is rotatable in an arrow direction (clockwise).

After the toner image has been developed by the developing section 46, the transfer section 48 transfers the toner image from the surface of the image bearing member 30 to the recording medium P. The transfer section 48 is for example a transfer roller.

The fixing section 52 applies either or both of heat and pressure to the unfixed toner image transferred to the recording medium P by the transfer section 48. The fixing section 52 is for example either or both of a heating roller and a pressure roller. The toner image is fixed to the recording medium P through application of either or both of heat and pressure to the toner image. As a result, an image is formed on the recording medium P.

Through the above, an example of the image forming apparatus according to the second embodiment has been described. However, the image forming apparatus according to the second embodiment is not limited to the image forming apparatus 100 described above. For example, the image forming apparatus according to the second embodiment is not limited to the above-described tandem image forming apparatus 100 and may alternatively be a rotary image forming apparatus. Furthermore, the image forming apparatus according to the second embodiment may be a monochrome image forming apparatus. In this case, for example, the image forming apparatus can include only one image formation unit. The image forming apparatus according to the second embodiment may adopt an intermediate transfer process. In a configuration in which the image forming apparatus according to the second embodiment adopts an intermediate transfer process, the transfer target is an intermediate transfer belt.

EXAMPLES

The following provides more specific description of the present invention through use of Examples. However, the present invention is not in any way limited by the scope of the Examples.

<Materials of Photosensitive Member>

A hole transport material, binder resins, and pigments described below were prepared as materials for producing photosensitive members.

[Hole Transport Material]

A hole transport material (HTM-1) represented by chemical formula (HTM-1) shown below was prepared.

(HTM-1)

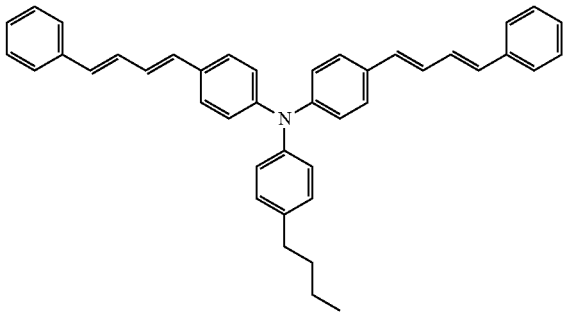

[Binder Resin]

The polyarylate resins (R-1) to (R-6) described in association with the first embodiment and a polycarbonate resin (R-7) were prepared. The polycarbonate resin (R-7) is a polycarbonate resin including a repeating unit represented by chemical formula (R-7) shown below.

(R-7)

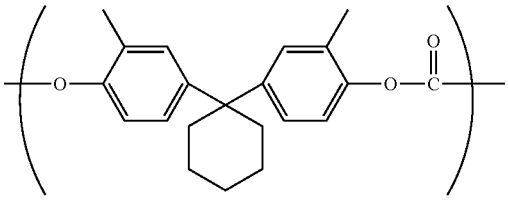

{Synthesis Methods of Polyarylate Resins (R-1) to (R-6)}

The following describes methods for synthesizing the polyarylate resins (R-1) to (R-6).

(Synthesis Method of Polyarylate Resin (R-1))

A three-necked flask having a capacity of 1 L and equipped with a thermometer, a three-way cock, and a dripping funnel was used as a reaction vessel. Into the reaction vessel, 12.2 g (41.3 mmol) of 1,1-bis(4-hydroxy-3-methylphenyl)cyclohexane, 0.06 g (0.41 mmol) of t-butylphenol 3.9 g (98 mmol) of sodium hydroxide, and 0.12 g (0.38 mmol) of benzyltributlammonium chloride were added. Next, the reaction vessel was purged with argon. Next, 600 mL of water was added into the reaction vessel. The internal temperature of the reaction vessel was kept at 20° C., and the reaction vessel contents were stirred for 1 hour. Next, the reaction vessel contents were cooled to reduce the internal temperature of the reaction vessel to 10° C. Thus, an alkaline aqueous solution was prepared.

Separately from the alkaline aqueous solution, 4.5 g (16.2 mmol) of 4,4'-biphenyldicarboxylic acid dichloride and 4.1 g (16.2 mmol) of 2,6-naphthalenedicarboxylic acid dichloride were dissolved in 300 g of chloroform to prepare a chloroform solution.

Next, the chloroform solution was added into the alkaline aqueous solution while the alkaline aqueous solution was kept at 10° C. and the reaction vessel contents were stirred to initiate a polymerization reaction. The polymerization reaction was caused to proceed for 3 hours while the reaction vessel contents were stirred and the internal temperature of the reaction vessel was kept at 13±3° C. Thereafter, decantation was performed to remove an upper layer (water layer) to collect an organic layer.

Next, 500 mL of ion exchanged water was added into a three-necked flask having a capacity of 2 L, and then the collected organic layer was added into the flask. Furthermore, 300 g of chloroform and 6 mL of acetic acid were added into the flask. The three-necked flask contents were stirred at room temperature (25° C.) for 30 minutes. Thereafter, decantation was performed to remove an upper layer (water layer) from the three-necked flask contents to collect an organic layer. The collected organic layer was washed with 500 mL of ion exchanged water using a separatory funnel. Washing with ion exchanged water was repeated eight times, and thus the water-washed organic layer was obtained.

Next, the water-washed organic layer was filtered to collect a filtrate. Into a conical flask having a capacity of 3 L, 1.5 L of methanol was added. The collected filtrate was gradually dripped into the conical flask to give a precipitate. The precipitate was filtered off. The thus collected precipitate was vacuum dried for 12 hours at 70° C. As a result, the polyarylate resin (R-1) having a viscosity average molecular weight of 46,000 was obtained.

(Synthesis Methods of Polyarylate Resins (R-2) to (R-6))

Each of the polyarylate resins (R-2) to (R-6) was synthesized according to the same method as for the polyarylate resin (R-1) in all aspects other than that 4,4'-biphenyldicarboxylic acid dichloride and 2,6-naphthalenedicarboxylic acid dichloride were changed to aryloyl halides that were starting materials of the polyarylate resin. The total amount by mole of the aryloyl halides in the synthesis of each of the polyarylate resins (R-2) to (R-6) was equal to the total amount by mole of the aryloyl halides in the synthesis of the polyarylate resin (R-1). The polyarylate resins (R-2) to (R-6) had viscosity average molecular weights of 45,500, 51,200, 50,100, 46,800, and 49,500, respectively.

Figure 4:
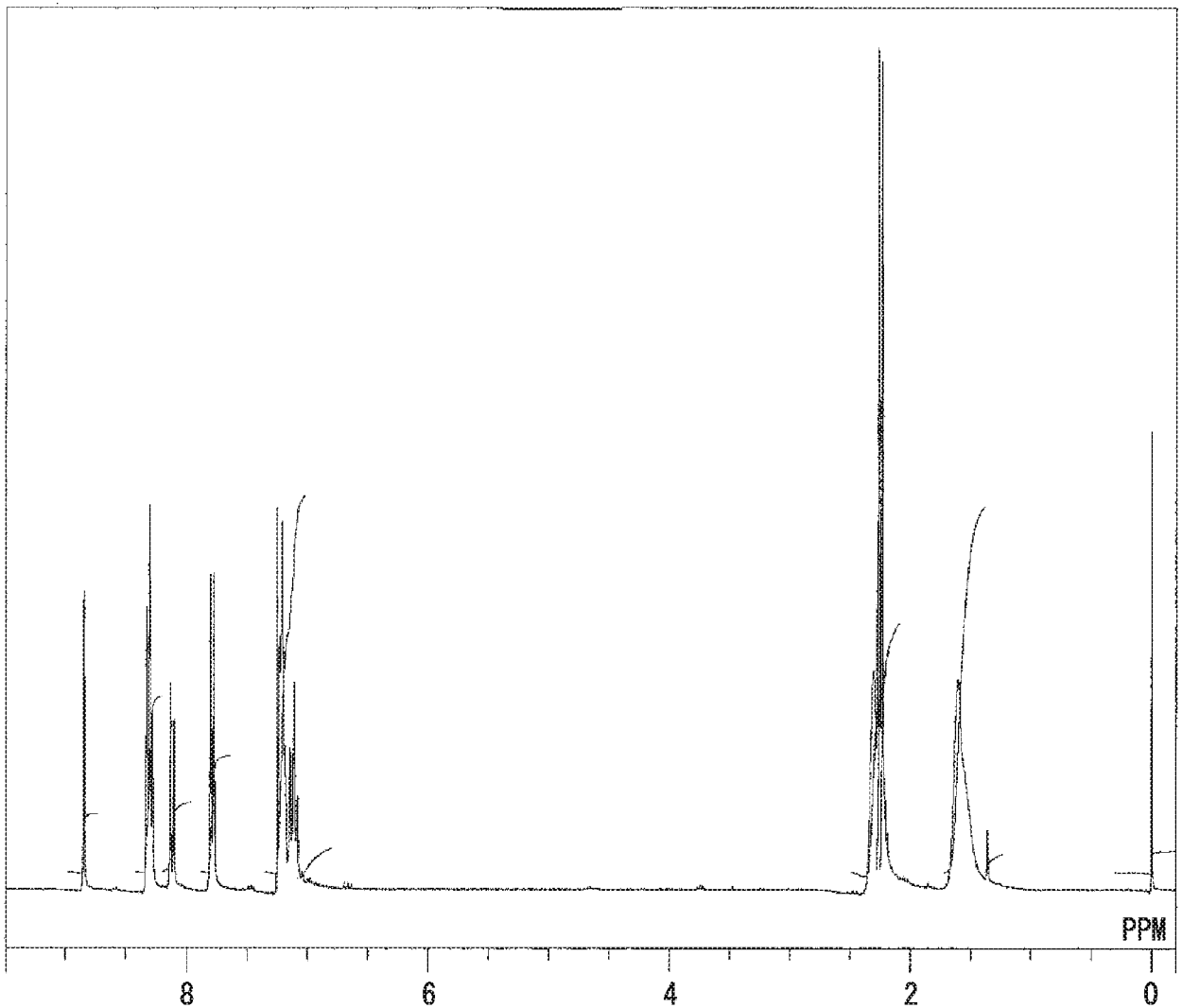
FIG. 4 is a $^{1}$H-NMR spectrum of a polyarylate resin represented by chemical formula (R-1).

Next, $^{1}$H-NMR spectra of the synthesized polyarylate resins (R-1) to (R-6) were measured using a proton nuclear magnetic resonance spectrometer (product of JASCO Corporation, resonance frequency: 300 MHz). Chloroform-d was used as a solvent. Tetramethylsilane (TMS) was used as an internal standard sample. FIG. 4 shows the $^{1}$H-NMR spectrum of the polyarylate resin (R-1) as a representative example of the polyarylate resins (R-1) to (R-6). In FIG. 4, the horizontal axis represents chemical shift (unit: ppm) and the vertical axis represents signal intensity (unit: arbitrary unit). The $^{1}$H-NMR spectrum shown in FIG. 4 confirmed that the polyarylate resin (R-1) had been obtained. Likewise, the $^{1}$H-NMR spectra of the other polyarylate resins (R-2) to (R-6) confirmed that the polyarylate resins (R-2) to (R-6) had been obtained.

[Pigment]

The pigments (D-1) to (D-5) described in association with the first embodiment and a pigment (D-6) were prepared. The pigment (D-6) is a pigment represented by chemical formula (D-6) shown below.

(D-6)

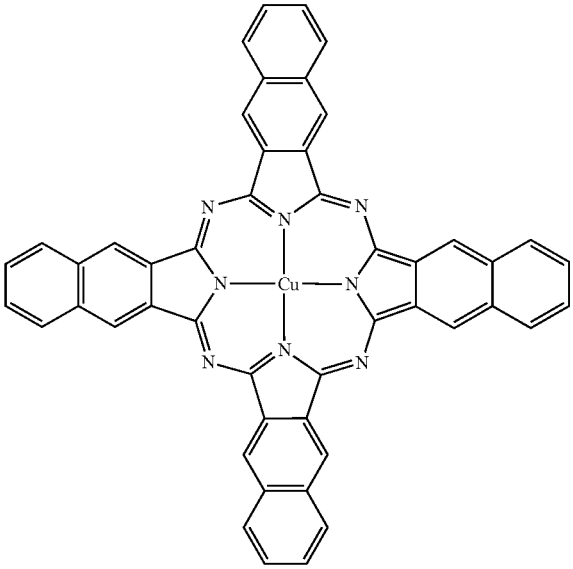

<Production of Photosensitive Member>

Example 1

The following describes a production method of a photosensitive member according to Example 1.

(Intermediate Layer Formation)

First, surface-treated titanium oxide ("test sample SMT-A", product of Tayca Corporation, average primary particle diameter: 10 nm) was prepared. Specifically, the titanium oxide was surface-treated using alumina and silica, and was also subsequently surface-treated using methyl hydrogen polysiloxane while being subjected to wet dispersion. The surface-treated titanium oxide (2 parts by mass) and AMILAN (registered Japanese trademark) ("CM8000", product of Toray Industries, Inc.), which is a polyamide resin, (1 part by mass) were added into a solvent. AMILAN is a four-component copolymer polyamide resin of polyamide 6, polyamide 12, polyamide 66, and polyamide 610. A solvent containing methanol (10 parts by mass), butanol (1 part by mass), and toluene (1 part by mass) was used as the solvent. The surface-treated titanium oxide, AMILAN, and the solvent were mixed for 5 hours using a bead mill to disperse the materials in the solvent. The resultant dispersion was filtered using a filter having a pore size of 5 μm. Thus, an application liquid for intermediate layer formation was prepared.

The thus prepared application liquid for intermediate layer formation was applied onto a surface of a conductive substrate—an aluminum drum-shaped support (diameter: 30 mm, total length: 246 mm)—by dip coating. Next, the applied application liquid for intermediate layer formation was dried for 30 minutes at 130° C., thereby forming an intermediate layer (film thickness: 1.5 μm) on the conductive substrate (drum-shaped support).

(Charge Generating Layer Formation)

Y-form titanyl phthalocyanine (1.5 parts by mass) and a polyvinyl acetal resin ("S-LEC BX-5", product of Sekisui Chemical Co., Ltd.) (1 part by mass) as a base resin were added into a solvent. A solvent containing propylene glycol monomethyl ether (40 parts by mass) and tetrahydrofuran (40 parts by mass) was used as the solvent. The Y-form titanyl phthalocyanine, the polyvinyl acetal resin, and the solvent were mixed for 12 hours using a bead mill to disperse the materials in the solvent. The resultant dispersion was filtered using a filter having a pore size of 3 μm. Thus, an application liquid for charge generating layer formation was prepared. The thus prepared application liquid for charge generating layer formation was applied onto the intermediate layer formed as described above by dip coating and dried at 50° C. for 5 minutes. Through the above, a charge generating layer (film thickness: 0.3 μm) was formed on the intermediate layer.

(Charge Transport Layer Formation)

Into a solvent, 50.00 parts by mass of the hole transport material (HTM-1), 2.00 parts by mass of a hindered phenolic antioxidant (IRGANOX (registered Japanese trademark) 1010, product of BASF Japan Ltd.) as an additive, 2.00 parts by mass of 3,3',5,5'-tetra-tert-butyl-4,4'-diphenoquinone as an electron acceptor compound, 100.00 parts by mass of the polyarylate resin (R-1) as a binder resin, and 0.20 parts by mass of the pigment (D-1) were added. A solvent containing 350.00 parts by mass of tetrahydrofuran and 350.00 parts by mass of toluene was used as the solvent. The materials were dispersed in the solvent for 2 minutes using an ultrasonic disperser to prepare an application liquid for charge transport layer formation.

Next, the application liquid for charge transport layer formation was applied onto the charge generating layer in the same manner as for the application liquid for charge generating layer formation described above. Thereafter, the application liquid for charge transport layer formation was dried at 120° C. for 40 minutes to form a charge transport layer (film thickness: 15 μm) on the charge generating layer, thereby producing the photosensitive member according to Example 1. Another photosensitive member according to Example 1 was produced according to the same method as described above other than that the film thickness of the charge transport layer was changed to 30 μm. Both of these two photosensitive members had a structure in which the intermediate layer, the charge generating layer, and the charge transport layer were stacked on the conductive substrate in the stated order. Note that a photosensitive member with a charge transport layer having a film thickness of 15 μm is also referred to below as a CT15 photosensitive member. A photosensitive member with a charge transport layer having a film thickness of 30 μm is also referred to below as a CT30 photosensitive member.

Examples 2 to 12 and Comparative Examples 1 to 3

As photosensitive members according to Examples 2 to 12 and Comparative Examples 1 to 3, CT15 photosensitive members and CT30 photosensitive members were produced according to the same method as in Example 1 other than the following changes.

(Changes)

The resins shown in Table 2 were used while the polyarylate resin (R-1) was used as the binder resin in the production of the photosensitive member according to Example 1. The pigments each in an amount shown in Table 2 were used while the pigment (D-1) in the above-specified amount was used in the production of the photosensitive member according to Example 1. Note that R-1 to R-7 in the column titled "Resin" of Table 2 respectively indicate the polyarylate resins (R-1) to (R-6) and the polycarbonate resin (R-7). D-1 to D-6 in the column titled "Type" under "Pigment" respectively indicate the pigments (D-1) to (D-6). The values in the column titled "Amount" under "Pigment" indicate amounts of the pigments in terms of parts by mass relative to 100.00 parts by mass of the respective resins.

<Evaluation Methods>

[Transmittance of Charge Transport Layer]

With respect to each of the charge transport layers of the CT30 photosensitive members according to Examples 1 to 12 and Comparative Examples 1 to 3, the transmittance of the charge transport layer for light having an irradiation wavelength (780 nm) was measured according to a method described below. The application liquid for charge transport layer formation used for the formation of each of the charge transport layers of the photosensitive members according to Examples 1 to 12 and Comparative Examples 1 to 3 was prepared. The application liquid for charge transport layer formation was applied onto an overhead projector sheet (OHP sheet), and then dried at 120° C. for 40 minutes to form a charge transport layer having a film thickness of 30 μm. The transmittance of the resultant charge transport layer for light having a wavelength of 780 nm was measured using a spectrophotometer ("C-3000", product of Hitachi High-Technologies Corporation). The results are shown in Table 3.

[Electrical Characteristics]

(Post-Irradiation Potential)

With respect to each of the CT30 photosensitive members according to Examples 1 to 12 and Comparative Examples 1 to 3, the photosensitive member was charged using a drum sensitivity test device (product of Gen-Tech, Inc.) under conditions of a rotational speed of 31 rpm and a charge potential of −600 V Next, the surface of the photosensitive member was irradiated with monochromatic light (wavelength: 780 nm, exposure light intensity: 1.0 μJ/cm$^2$) that had been isolated from light emitted by a halogen lamp using a band pass filter. A surface potential of the photosensitive member was measured 66.7 milliseconds after completion of the irradiation with the monochromatic light (exposure light). The surface potential was measured at a temperature of 23° C. and a relative humidity of 50%. The thus measured surface potential was taken to be a post-irradiation potential ($V_L$). The results are shown in Table 3.

(Change in Electrical Characteristics Due to Decrease in Thickness of Photosensitive Layer)

With respect to each of the CT30 photosensitive members according to Examples 1 to 12 and Comparative Examples 1 to 3, the photosensitive member was charged using a drum sensitivity test device (product of Gen-Tech, Inc.) under conditions of a rotational speed of 31 rpm and a charge potential of −600 V. Next, the surface of the photosensitive member was irradiated with monochromatic light (wavelength: 780 nm, exposure light intensity: 0.05 μJ/cm$^2$) that had been isolated from light emitted by a halogen lamp using a band pass filter. The surface potential of the photosensitive member was measured 66.7 milliseconds after completion of the irradiation with the monochromatic light. Next, the exposure light intensity was gradually increased from 0.05 μJ/cm$^2$ to 1.00 J/cm$^2$ in increments of 0.05 μJ/cm$^2$, and the surface potential was measured for each exposure light intensity according to the same method as described above. The surface potential for each exposure light intensity was measured at a temperature of 23° C. and a relative humidity of 50%. Next, a linear approximation of the thus obtained surface potential was performed relative to the exposure light intensity by a least-squares method, yielding a linear function. The linear function was used to calculate an exposure light intensity that gives a surface potential of −300 V. The thus calculated exposure light intensity was taken to be E1/2 (unit: μJ/cm$^2$) of the CT30 photosensitive member. The exposure light intensity that gives a surface potential of −300 V was calculated for each of the CT15 photosensitive members according to Examples 1 to 12 and Comparative Examples 1 to 3 according to the same method as described above and was taken to be E1/2 (unit: μL/cm$^2$) of the CT15 photosensitive member. Next, E1/2 of the CT15 photosensitive member was divided by E1/2 of the CT30 photosensitive member to calculate an E1/2 ratio (CT15/CT30) between the CT30 photosensitive member and the CT15 photosensitive member. The results are shown in Table 3. A smaller value of the E1/2 ratio (CT15/CT30) indicates a higher degree of inhibition of reduction of the electrical characteristics due to a decrease in thickness of the photosensitive layer.

[Abrasion Loss]

The application liquid for charge transport layer formation used for the formation of each of the charge transport layers of the photosensitive members according to Examples 1 to 12 and Comparative Examples 1 to 3 was prepared. The application liquid for charge transport layer formation was applied onto a polypropylene sheet (thickness: 0.3 mm) wrapped around an aluminum pipe (diameter: 78 mm), The application liquid was then dried at 120° C. for 40 minutes to prepare an abrasion evaluation test sheet with a charge transport layer having a film thickness of 30 μm formed thereon.

Next, the charge transport layer was removed from the polypropylene sheet of the abrasion evaluation test sheet and mounted on a specimen mounting card ("S-36", product of TABER Industries) to prepare a sample. The thus prepared sample was loaded in a rotary abrasion tester (product of Toyo Seiki Co., Ltd.) and subjected to 1,000 rotations using a wear ring ("H-10", product of TABER Industries) under conditions of a 1,000 gf load and a rotation speed of 60 rpm to perform an abrasion evaluation test. A difference in mass of the sample before and after the abrasion evaluation test was measured, and the measured difference was taken to be an abrasion loss (mg/1,000 rotations). The results are shown in Table 3. Note that a smaller value of the abrasion loss indicates higher abrasion resistance.

TABLE 2

| | | Pigment | | |
|---|---|---|---|---|
| | Resin | Type | Maximum absorption wavelength (nm) | Amount (parts by mass) |
| Example 1 | R-1 | D-1 | 784 | 0.20 |
| Example 2 | R-1 | D-2 | 769 | 0.20 |
| Example 3 | R-1 | D-3 | 808 | 0.20 |
| Example 4 | R-1 | D-4 | 867 | 0.20 |
| Example 5 | R-1 | D-5 | 853 | 0.20 |
| Example 6 | R-2 | D-1 | 784 | 0.20 |
| Example 7 | R-3 | D-1 | 784 | 0.20 |
| Example 8 | R-4 | D-1 | 784 | 0.20 |
| Example 9 | R-5 | D-1 | 784 | 0.20 |
| Example 10 | R-6 | D-1 | 784 | 0.20 |
| Example 11 | R-1 | D-1 | 784 | 0.10 |
| Example 12 | R-1 | D-1 | 784 | 0.60 |
| Comparative Example 1 | R-1 | | None | |
| Comparative Example 2 | R-1 | D-6 | 692 | 0.20 |
| Comparative Example 3 | R-7 | D-1 | 784 | 0.20 |

TABLE 3

| | | Electrical characteristics | | | | |
|---|---|---|---|---|---|---|
| | | | E½ | | | |
| | Transmittance of charge transport layer (%) | $V_L$ (V) | CT30 photosensitive member (μJ/cm²) | CT15 photosensitive member (μJ/cm²) | E½ ratio (CT15/CT30) | Abrasion loss (mg/1,000 rotations) |
| Example 1 | 37 | −61 | 0.18 | 0.20 | 1.11 | 5.8 |
| Example 2 | 44 | −58 | 0.17 | 0.20 | 1.18 | 6.0 |
| Example 3 | 52 | −60 | 0.15 | 0.18 | 1.20 | 5.8 |
| Example 4 | 65 | −58 | 0.12 | 0.14 | 1.17 | 5.8 |
| Example 5 | 72 | −62 | 0.11 | 0.14 | 1.27 | 5.9 |
| Example 6 | 36 | −62 | 0.18 | 0.20 | 1.11 | 5.8 |
| Example 7 | 36 | −57 | 0.18 | 0.20 | 1.11 | 6.1 |
| Example 8 | 38 | −59 | 0.18 | 0.20 | 1.11 | 6.4 |
| Example 9 | 37 | −59 | 0.19 | 0.20 | 1.05 | 6.9 |
| Example 10 | 37 | −60 | 0.18 | 0.20 | 1.11 | 6.9 |
| Example 11 | 70 | −52 | 0.11 | 0.13 | 1.18 | 5.9 |
| Example 12 | 13 | −77 | 0.31 | 0.29 | 0.94 | 6.0 |
| Comparative Example 1 | 98 | −55 | 0.08 | 0.16 | 2.00 | 8.5 |
| Comparative Example 2 | 78 | −57 | 0.09 | 0.16 | 1.80 | 7.1 |
| Comparative Example 3 | 30 | −63 | 0.18 | 0.21 | 1.17 | 9.2 |

As shown in Table 2, the charge transport layer of each of the photosensitive members according to Examples 1 to 12 contained any of the polyarylate resins (R-1) to (R-6) including a repeating unit encompassed by general formula (1). The charge transport layer of each of the photosensitive members according to Examples 1 to 12 contained any of the pigments (D-1) to (D-5) encompassed by general formula (2) or general formula (3). As shown in Table 3, each of the photosensitive members according to Examples 1 to 12 resulted in an E1/2 ratio (CT5/CT30) of at least 0.94 and no greater than 1.27. Each of the photosensitive members according to Examples 1 to 12 resulted in an abrasion loss of at least 5.8 mg/1,000 rotations and no greater than 6.9 mg/1,000 rotations.

As shown in Table 2, the charge transport layer of the photosensitive member according to Comparative Example 3 contained the polycarbonate resin (R-7) including a repeating unit that was not encompassed by general formula (1). The charge transport layer of the photosensitive member according to Comparative Example 2 contained the pigment (D-6) that was not encompassed by general formula (2) or general formula (3). The charge transport layer of the photosensitive member according to Comparative Example 1 contained no pigment. As shown in Table 3, the photosensitive members according to Comparative Examples 1 and 2 each resulted in an E1/2 ratio (CT15/CT30) of greater than 1.50. The photosensitive members according to Comparative Examples 1 to 3 each resulted in an abrasion loss of greater than 7.0 mg/1,000 rotations.

As evident from the results above, each of the photosensitive members according to Examples 1 to 12 showed higher abrasion resistance than the photosensitive members according to Comparative Examples 1 to 3. Each of the photosensitive members according to Examples 1 to 12 inhibited reduction of its electrical characteristics due to a decrease in thickness of the photosensitive layer more than the photosensitive members according to Comparative Examples 1 and 2.

INDUSTRIAL APPLICABILITY

The electrophotographic photosensitive member according to the present invention is applicable to image forming apparatuses such as multifunction peripherals.

The invention claimed is:

1. An electrophotographic photosensitive member comprising:

a conductive substrate; and a photosensitive layer disposed directly or indirectly on the conductive substrate, wherein the photosensitive layer has a charge generating layer and a charge transport layer disposed in order from the conductive substrate, the charge generating layer contains a charge generating material, the charge transport layer contains a charge transport material, a binder resin, and a pigment that absorbs light having an irradiation wavelength, the binder resin includes a polyarylate resin including a repeating unit represented by general formula (1) shown below, and the pigment is a naphthalocyanine compound represented by general formula (2) or general formula (3) shown below, (1)

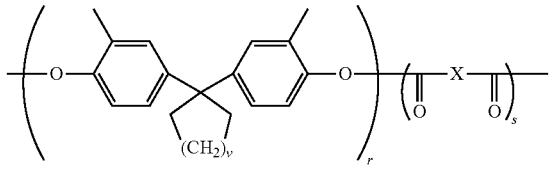

-continued

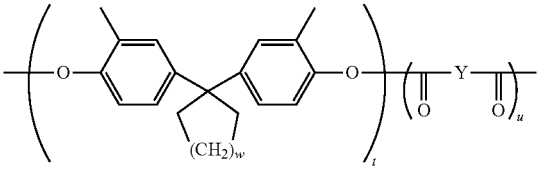

where in general formula (1), v and w each represent, independently of one another, 2 or 3, r, s, t, and u each represent, independently of one another, a number greater than or equal to 0, r+s+t+u=100, r+t=s+u, r/(r+t) is at least 0.00 and no greater than 0.90, s/(s+u) is at least 0.00 and no greater than 0.90, and X and Y each represent, independently of one another, a divalent group represented by chemical formula (1-1), chemical formula (1-2), chemical formula (1-3), or chemical formula (1-4) shown below, (1-1)

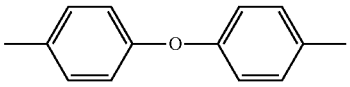

(1-2)

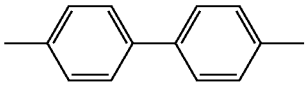

(1-3)

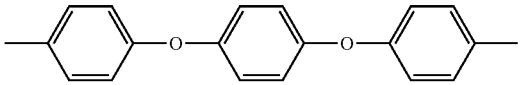

(1-4)

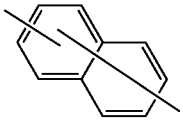

(2)

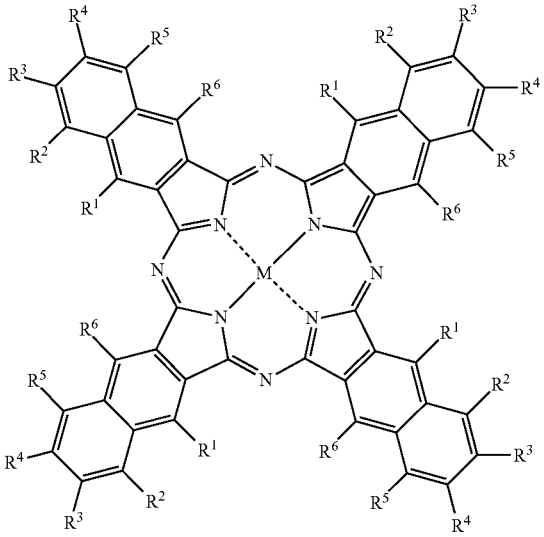

in general formula (2), $R^1$, $R^2$, $R^3$, $R^4$, $R^5$, and $R^6$ each represent, independently of one another, a hydrogen atom, an alkyl group optionally having a substituent and having a carbon number of at least 1 and no greater than 6, an aryl group optionally having a substituent and having a carbon number of at least 6 and no greater than 14, an alkoxy group optionally having a substituent and having a carbon number of at least 1 and no greater than 6, a phenoxy group optionally having a substituent, a thioalkyl group optionally having a substituent and having a carbon number of at least 1 and no greater than 6, or a thiophenyl group optionally having a substituent, with the proviso that $R^1$, $R^2$, $R^3$, $R^4$, $R^5$, and $R^6$ do not all simultaneously represent hydrogen atoms, and M represents a metal atom optionally having a ligand, and (3)

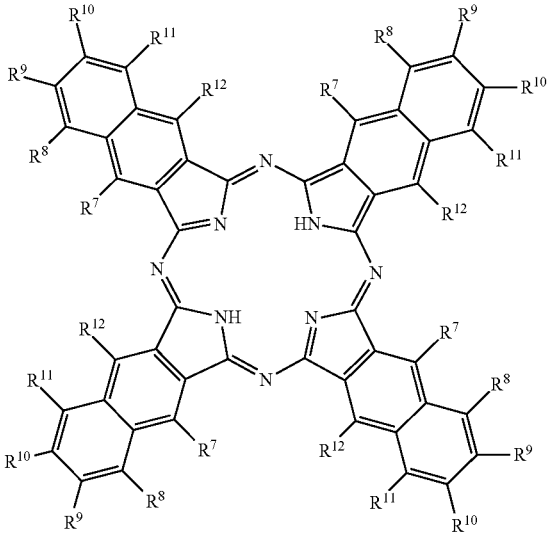

in general formula (3), $R^7$, $R^8$, $R^9$, $R^{10}$, $R^{11}$, and $R^{12}$ each represent, independently of one another, a hydrogen atom, an alkyl group optionally having a substituent and having a carbon number of at least 1 and no greater than 6, an aryl group optionally having a substituent and having a carbon number of at least 6 and no greater than 14, an alkoxy group optionally having a substituent and having a carbon number of at least 1 and no greater than 6, a phenoxy group optionally having a substituent, a thioalkyl group optionally having a substituent and having a carbon number of at least 1 and no greater than 6, or a thiophenyl group optionally having a substituent, with the proviso that $R^7$, $R^8$, $R^9$, $R^{10}$, $R^{11}$, and $R^{12}$ do not all simultaneously represent hydrogen atoms.

2. The electrophotographic photosensitive member according to claim 1, wherein in general formula (1), v and w each represent 3.

3. The electrophotographic photosensitive member according to claim 2, wherein the polyarylate resin is represented by chemical formula (R-1), chemical formula (R-2), chemical formula (R-3), chemical formula (R-4), chemical formula (R-5), or chemical formula (R-6) shown below (R-1)
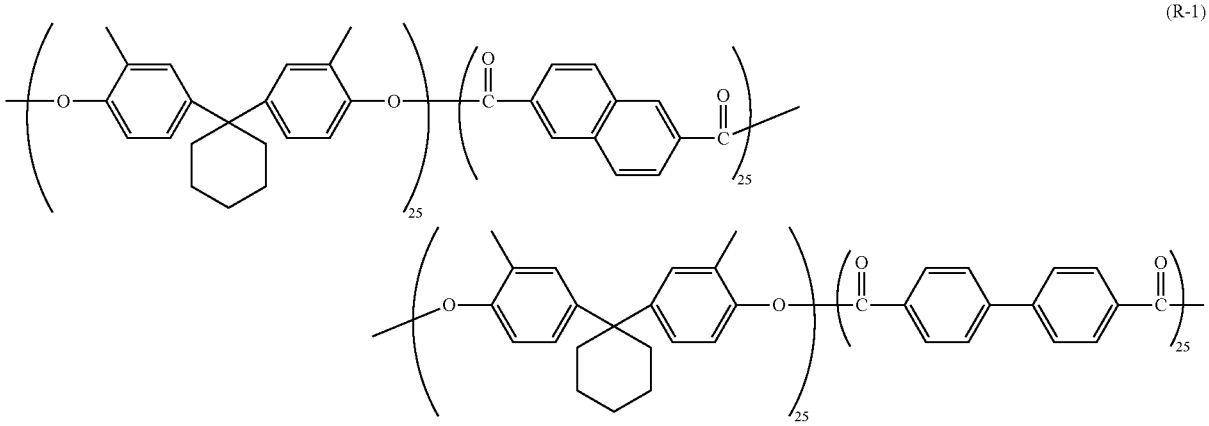
(R-2)
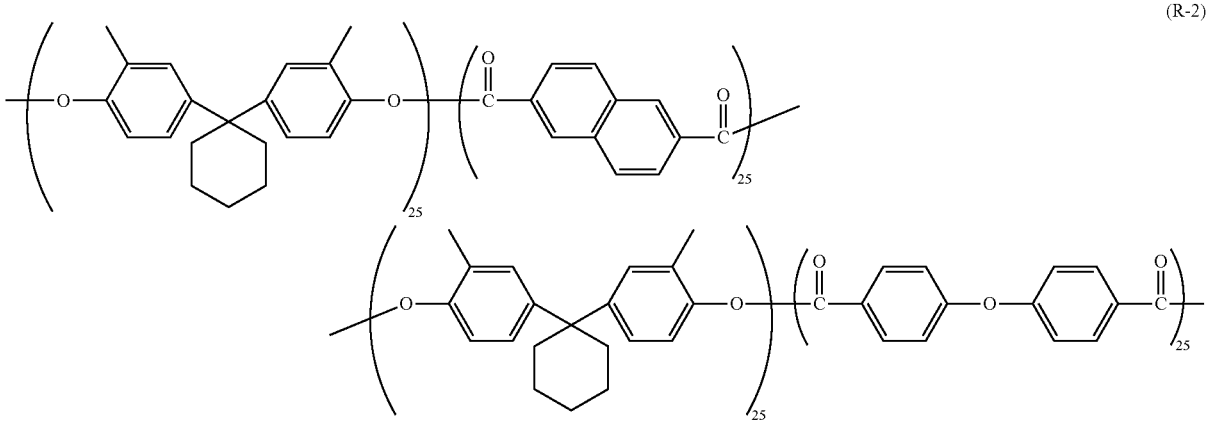
(R-3)
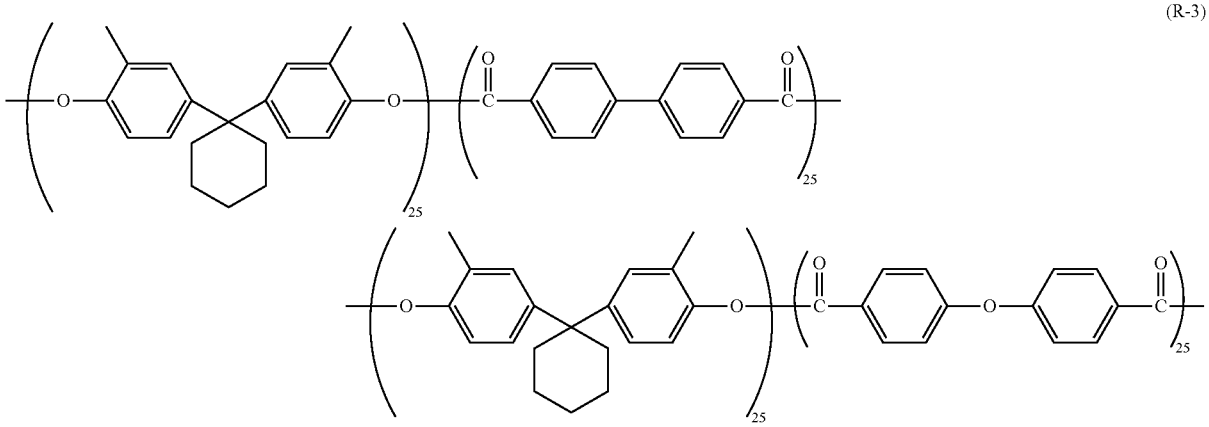
(R-4)
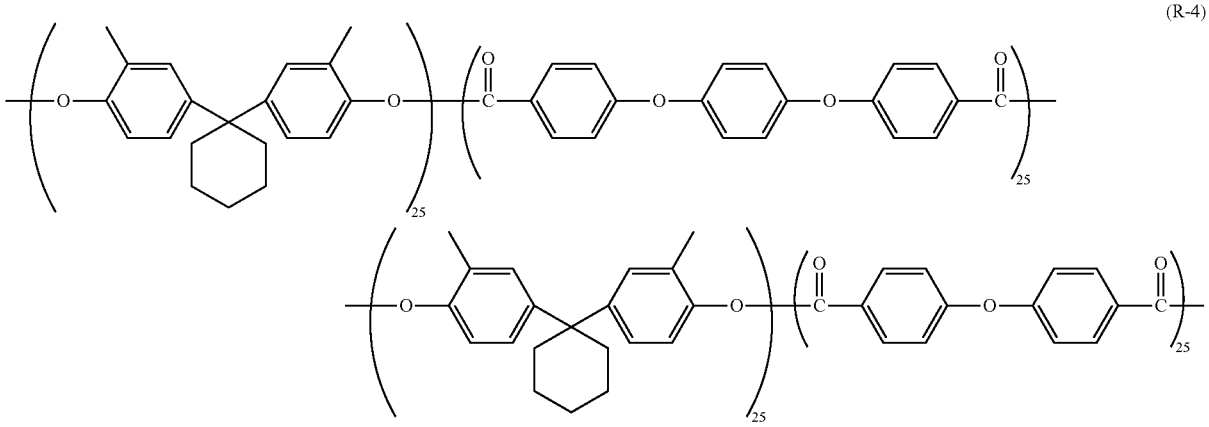

-continued (R-5)

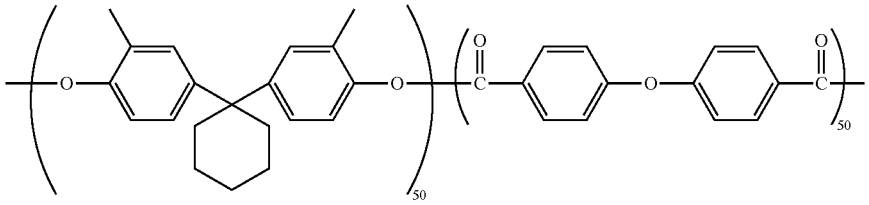

(R-6)

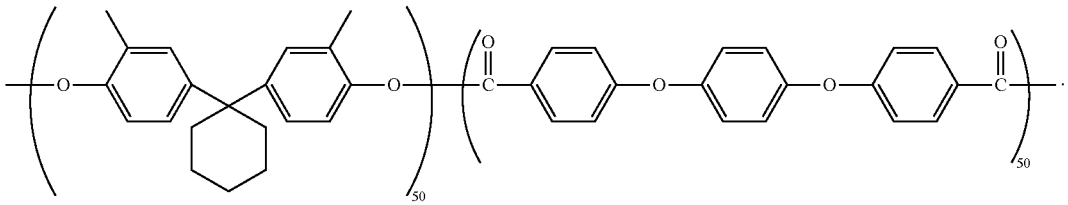

4. The electrophotographic photosensitive member according to claim 1, wherein in general formula (1), r/(r+t) is at least 0.30 and no greater than 0.70, s/(s+u) is at least 0.30 and no greater than 0.70, and X and Y are different from one another.

5. The electrophotographic photosensitive member according to claim 4, wherein in general formula (1), X and Y each represent, independently of one another, the divalent group represented by chemical formula (1-1), chemical formula (1-2), or chemical formula (1-4).

6. The electrophotographic photosensitive member according to claim 5, wherein in general formula (1), X is the divalent group represented by chemical formula (1-4), and Y is the divalent group represented by chemical formula (1-1) or chemical formula (1-2).

7. The electrophotographic photosensitive member according to claim 1, wherein the pigment is the naphthalocyanine compound represented by general formula (2), and in general formula (2), $R^1$, $R^2$, $R^3$, $R^4$, $R^5$, and $R^6$ each represent, independently of one another, a hydrogen atom, an alkyl group optionally having a substituent and having a carbon number of at least 1 and no greater than 6, or an alkoxy group optionally having a substituent and having a carbon number of at least 1 and no greater than 6, and M represents a copper atom optionally having a ligand, a zinc atom optionally having a ligand, or a vanadium atom optionally having a ligand.

8. The electrophotographic photosensitive member according to claim 7, wherein in general formula (2), $R^1$ and $R^6$ each represent, independently of one another, a hydrogen atom or an alkoxy group having a carbon number of at least 1 and no greater than 6, $R^2$, $R^3$, and $R^5$ each represent a hydrogen atom, and $R^4$ represents a hydrogen atom or an alkyl group having a carbon number of at least 1 and no greater than 6.

9. The electrophotographic photosensitive member according to claim 1, wherein the pigment is the naphthalocyanine compound represented by general formula (3), and in general formula (3), $R^7$, $R^8$, $R^9$, $R^{10}$, $R^{11}$, and $R^{12}$ each represent, independently of one another, a hydrogen atom, an alkyl group optionally having a substituent and having a carbon number of at least 1 and no greater than 6, or an alkoxy group optionally having a substituent and having a carbon number of at least 1 and no greater than 6.

10. The electrophotographic photosensitive member according to claim 9, wherein in general formula (3), $R^7$ and $R^{12}$ each represent, independently of one another, a hydrogen atom or an alkoxy group having a carbon number of at least 1 and no greater than 6, $R^8$, $R^9$, and $R^{11}$ each represent a hydrogen atom, and $R^{10}$ represents a hydrogen atom or an alkyl group having a carbon number of at least 1 and no greater than 6.

11. The electrophotographic photosensitive member according to claim 10, wherein in general formula (3), $R^7$ and $R^{12}$ each represent a hydrogen atom, and $R^{10}$ represents an alkyl group having a carbon number of at least 1 and no greater than 6.

12. The electrophotographic photosensitive member according to claim 1, wherein the pigment is a naphthalocyanine compound represented by chemical formula (D-1), chemical formula (D-2), chemical formula (D-3), chemical formula (D-4), or chemical formula (D-5) shown below (D-1)
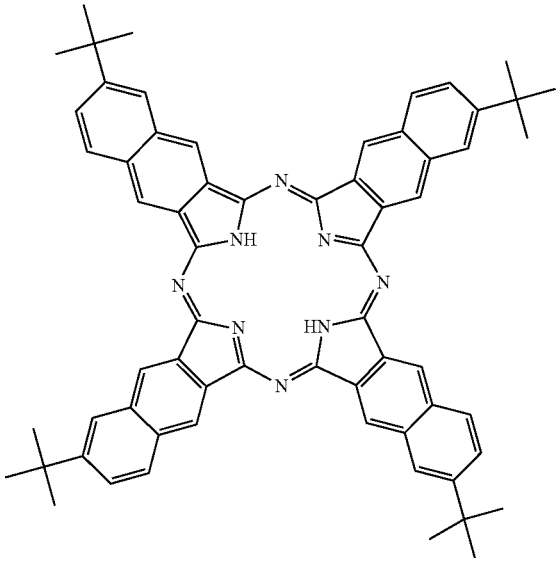
(D-2)
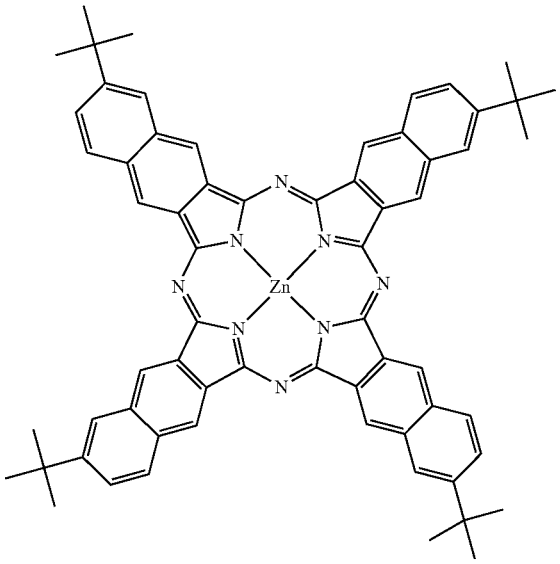
-continued
(D-3)
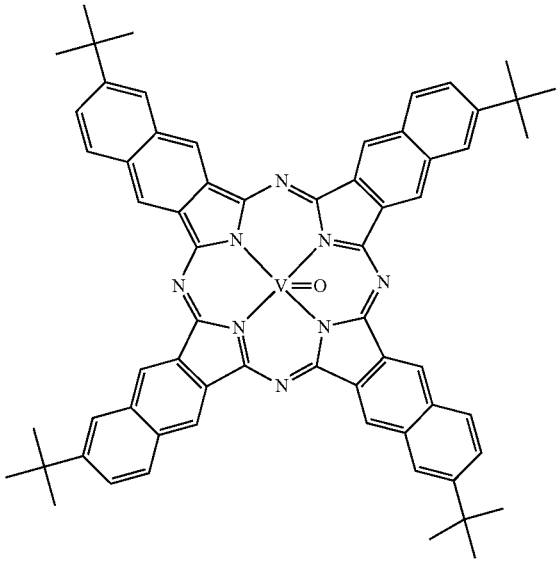
(D-4)
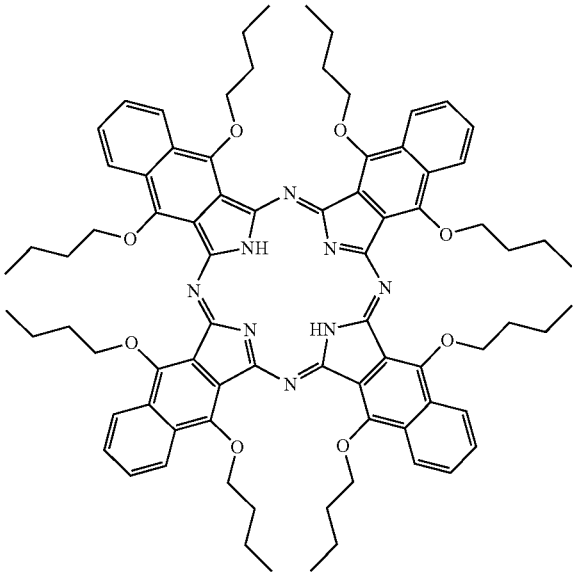

-continued (D-5)

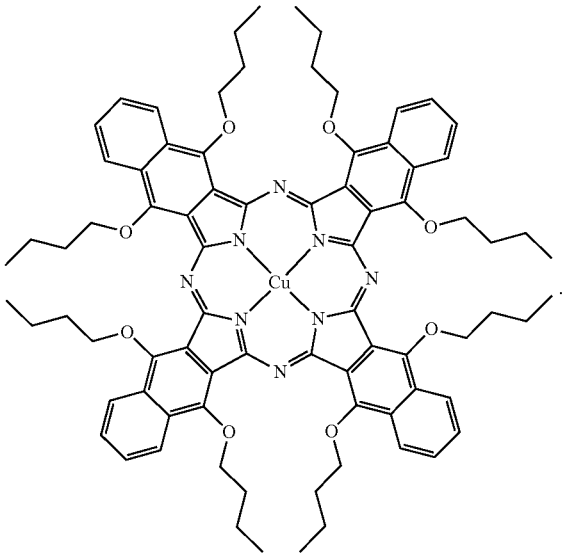

13. The electrophotographic photosensitive member according to claim 1, wherein the pigment is contained in an amount of at least 0.10 parts by mass and no greater than 0.60 parts by mass relative to 100.00 parts by mass of the binder resin.

14. The electrophotographic photosensitive member according to claim 1, wherein the charge transport layer has a transmittance of at least 5% and less than 80% for light having the irradiation wavelength.

15. An image forming apparatus comprising:

an image bearing member;

a charger configured to charge a surface of the image bearing member;

a light exposure section configured to expose the charged surface of the image bearing member to light to form an electrostatic latent image on the surface of the image bearing member;

a developing section configured to develop the electrostatic latent image into a toner image; and a transfer section configured to transfer the toner image from the image bearing member to a transfer target, wherein the image bearing member is the electrophotographic photosensitive member according to claim 1.

* * * * *